US008844704B2

(12) United States Patent
Bell

(10) Patent No.: US 8,844,704 B2
(45) Date of Patent: Sep. 30, 2014

(54) MONEY ITEM DISPENSING APPARATUS

(75) Inventor: Malcolm Reginald Hallas Bell, Leeds (GB)

(73) Assignee: Money Controls Limited, Royton Oldham (GB)

( * ) Notice: Subject to any disclaimer, the term of this patent is extended or adjusted under 35 U.S.C. 154(b) by 0 days.

(21) Appl. No.: 13/453,695

(22) Filed: Apr. 23, 2012

(65) Prior Publication Data

US 2012/0261434 A1 Oct. 18, 2012

Related U.S. Application Data

(63) Continuation of application No. 11/571,812, filed as application No. PCT/EP2005/053233 on Jul. 6, 2005, now Pat. No. 8,181,765.

(30) Foreign Application Priority Data

Jul. 7, 2004 (GB) ..... GB0415276.5

(51) Int. Cl.

| | |
|---|---|
| ***G07D 1/00*** | (2006.01) |
| ***G07D 9/04*** | (2006.01) |
| ***G07F 1/04*** | (2006.01) |
| ***G07D 3/14*** | (2006.01) |
| ***G07D 5/08*** | (2006.01) |
| ***G07D 9/00*** | (2006.01) |

(52) U.S. Cl.

CPC *G07D 9/008* (2013.01); *G07F 1/04* (2013.01); *G07D 3/14* (2013.01); *G07D 5/08* (2013.01)

USPC ..... 194/342; 453/56

(58) Field of Classification Search

USPC ..... 194/342, 344, 350; 453/18, 56, 33, 34, 453/35, 57; 221/174

See application file for complete search history.

(56) References Cited

U.S. PATENT DOCUMENTS

| | | | |
|---|---|---|---|
| 1,038,293 | A | 9/1912 | Chiger |
| 3,187,760 | A | 6/1965 | Simijian |

(Continued)

FOREIGN PATENT DOCUMENTS

| | | | |
|---|---|---|---|
| EP | 0 080 842 | A2 | 11/1982 |
| EP | 0 266 021 | A2 | 6/1987 |

(Continued)

OTHER PUBLICATIONS

Great Britain Search Report for GB0415276.5 dated Nov. 12, 2004.

(Continued)

*Primary Examiner* — Mark Beauchaine

(74) *Attorney, Agent, or Firm* — Orrick Herrington & Sutcliffe, LLP

(57) ABSTRACT

The application relates to money item dispensing apparatus having a money item acceptor and a hopper arrangement. The application further relates to money item dispensing apparatus having sorting means operable to selectively direct a money item to one of a first money item store and a second money item store, to money item dispensing apparatus having two hopper arrangements, to a money item acceptor having a self-clearing mechanism, to a money item conveyor, to a method of purging the money items in a money item dispensing apparatus, to money item dispensing apparatus having means for ejecting a money item from a receptacle through an outlet via a first path to a return tray and via a second path into a cashbox, to a method of filling a money item dispensing apparatus and filling apparatus for filling a money item dispensing apparatus.

9 Claims, 22 Drawing Sheets

(56) References Cited

U.S. PATENT DOCUMENTS

| | | | | | |
|---|---|---|---|---|---|
| 4,475,564 | A | * | 10/1984 | Koester et al. | 453/57 |
| 4,535,794 | A | | 8/1985 | Bellis et al. | |
| 4,635,661 | A | | 1/1987 | Uematsu et al. | |
| 5,052,538 | A | | 10/1991 | Satoh | |
| 5,074,824 | A | * | 12/1991 | Suris | 453/57 |
| 5,366,407 | A | | 11/1994 | Sentoku | |
| 5,377,807 | A | | 1/1995 | Kojima et al. | |
| 5,492,212 | A | * | 2/1996 | Fillod et al. | 194/202 |
| 5,531,640 | A | * | 7/1996 | Inoue | 453/17 |
| 5,554,070 | A | * | 9/1996 | Takatoshi et al. | 453/31 |
| 6,148,987 | A | | 11/2000 | Bernier et al. | |
| 6,328,646 | B1 | | 12/2001 | Abe et al. | |
| 6,386,964 | B1 | * | 5/2002 | Thomas | 453/17 |
| 6,579,166 | B2 | * | 6/2003 | Abe et al. | 453/56 |
| 6,695,689 | B2 | * | 2/2004 | Abe | 453/33 |
| 6,761,627 | B2 | | 7/2004 | Abe et al. | |
| 7,188,720 | B2 | | 3/2007 | Geib et al. | |
| 2002/0019210 | A1 | * | 2/2002 | Cole | 453/18 |
| 2002/0146975 | A1 | | 10/2002 | Seagle | |
| 2003/0024791 | A1 | | 2/2003 | Kurosawa et al. | |
| 2003/0032387 | A1 | | 2/2003 | Abe et al. | |
| 2003/0201146 | A1 | * | 10/2003 | Abe et al. | 194/302 |
| 2004/0259490 | A1 | | 12/2004 | Hino et al. | |

FOREIGN PATENT DOCUMENTS

| | | | |
|---|---|---|---|
| EP | 0 682 326 | A1 | 11/1995 |
| EP | 0 924 660 | A2 | 6/1999 |
| EP | 1 489 561 | A1 | 12/2004 |
| EP | 2 141 665 | A1 | 1/2010 |
| GB | 2 124 813 | A | 2/1984 |
| GB | 2 384 606 | A | 7/2003 |
| GB | 2 386 734 | A | 9/2003 |
| JP | 2002-329233 | | 11/2002 |

OTHER PUBLICATIONS

PCT International Search Report, PCT/EP2005/053233, dated Mar. 13, 2006.

PCT Written Opinion of the International Searching Authority, PCT/EP2005/053233, dated Jul. 7, 2004.

* cited by examiner

MONEY ITEM DISPENSING APPARATUS

CROSS-REFERENCE TO RELATED APPLICATIONS

This application is a continuation application of application Ser. No. 11/571,812, filed on Sep. 24, 2008, now U.S. Pat. No. 8,181,765 which claims priority to PCT/EP2005/053233 filed Jul. 6, 2005, and that claims priority to Great Britain Application No. 0415276.5 filed Jul. 7, 2004. Priority to each of the prior applications is expressly claimed, and the disclosures of the applications are hereby incorporated herein by reference in their entireties.

FIELD OF INVENTION

The invention relates to money item dispensing apparatus, a money item acceptor, a money item conveyor, a method of purging the money items in a money item dispensing apparatus, a method of filling a money item dispensing apparatus, filling apparatus for filling a money item dispensing apparatus. More specifically, this invention relates to apparatus for use with amusement machines, vending machines or other such coin or token operated machines for receiving, accepting, storing and dispensing coins and tokens, a method of purging money items in a money item dispensing apparatus, a conveyor and an apparatus and method for filling money item dispensing apparatus.

BACKGROUND OF THE INVENTION

Money item operated machines such as vending and amusement machines that are required to pay-out and receive money items conventionally comprise an internal acceptor unit as well as an internal hopper unit. Inserted money items such as coins and tokens enter the acceptor which verifies their authenticity and if accepted, may then be directed to a hopper for storage and subsequent payout. The hopper is activated to dispense money items when a payout to a user is required, such as in the case that a user has won a cash or token prize, or as change if, for instance, the user has inserted too much money.

Conventional money item acceptors include a rundown path down which money items travel edgewise through a sensing station having a plurality of sensors. These sensors detect characteristics of an inputted money item, a corresponding signal being provided to a processor that determines the authenticity of the money item. Examples of such acceptors are provided in our GB-A-O307 880, GB-A-2 169 429 and WO99/23615.

Hoppers for receiving, storing and ejecting coins are well known, an example being described in our EP-A-0080842. This relates to a hopper arrangement referred to as the Universal Hopper, which is manufactured by Money Controls Limited. This device overcomes some of the problems associated with previous hopper designs by employing a conveyor housed within the hopper to transport money items to an outlet. The conveyor comprises a plurality of hingedly interconnected portions, each having a lip designed to form a coin receptacle on the conveyor surface. Normally, the conveyor is stationary, but, when someone playing the machine to which the coin handling mechanism is fitted achieves a winning line requiring a payout to be made, an appropriate signal is generated to start a conveyor motor and drive the conveyor. This results in the conveyor being driven through the coins stored in the hopper so that some coins drop into spaces on the conveyor between adjacent lips. The coins are thus entrained upwardly towards an exit point, desirably with one coin resting on each lip, to be paid out through an outlet as a prize.

Despite the benefits afforded by the Universal Hopper arrangement, there remain a number of shortcomings when such units are installed in machines with conventional acceptor units. One shortcoming is the size of the gap between the acceptor money item input point and the money item return tray to which coins are directed having left either the acceptor or the hopper. The fact that the acceptor must generally be positioned above the hopper within the machine, and that both units should be manufactured to be secure and relatively impregnable and are therefore quite large, results in a relatively large gap between the user money item input point and return trays. This means that the machine may need to be provided with an area accessible by a user that is large enough to accommodate the relatively widely spaced input point and return tray. The gap between the input point and return tray can also be inconvenient for the user, particularly for gaming machines installed in dimly-lit areas, where the output tray can be difficult to locate.

A further shortcoming of currently used devices is that the acceptor and hopper units must be installed such that there is a continuous coin path between the acceptor coin outlet and the hopper coin inlet. This can prove inconvenient in some vending or gaming machines, particularly when there is a lack of space within the machine. It also makes installing the device complicated and therefore costly.

SUMMARY OF THE INVENTION

The present invention seeks to overcome these problems. In a first aspect the invention provides money item dispensing apparatus comprising a housing within which is included a money item acceptor, a selectably drivable loop conveyor whose path includes a money item receiving portion, and a money item store for receiving money items from the money item acceptor and for sequentially feeding a supply of money items to be dispensed into said money item receiving portion, the conveyor having a plurality of receptacles thereon, each of which is adapted to entrain, in use, a money item to be dispensed as the conveyor passes through the supply thereof in the money item receiving portion and transport it to an exit point.

There is further provided money item dispensing apparatus comprising a housing within which is included a money item acceptor, a selectably drivable rotary member being substantially disc-shaped and having a plurality of money item receptacles disposed annularly, a money item store for receiving money items from the money item acceptor and for continuously feeding a supply of money items to be dispensed into said plurality of money item receptacles, and a motor for selectably driving the rotary member to transport money items to an exit point.

Such apparatus overcome previous limitations by providing apparatus having a housing within which is included both an acceptor and a hopper. Accordingly the apparatus can have better security, compactness and ease of installation than previously known apparatus.

The payout speed of current hoppers is limited by factors such as the maximum speed at which the conveyor can be driven. It is often beneficial for hoppers to be able to pay out money more quickly, but without detriment to payout accuracy. Larger capacity hoppers are also advantageous, enabling greater maximum payouts for devices such as slot machines in casinos.

To address these limitations, in a further aspect the invention provides money item dispensing apparatus comprising a first selectably drivable endless loop conveyor whose path includes a first money item receiving portion, a first money item store—A—for sequentially feeding a first supply of money items to be dispensed into said first money item receiving portion, the first conveyor having a plurality of receptacles thereon, each of which is adapted to entrain, in use, a money item to be dispensed as the first conveyor passes through the first supply thereof in the first money item receiving portion and transport it to a first exit point, a second selectably drivable endless loop conveyor whose path includes a second money item receiving portion, and a second money item store for sequentially feeding a second supply of money items to be dispensed into said second money item receiving portion, the second conveyor having a plurality of receptacles thereon, each of which is adapted to entrain, in use, a money item to be dispensed as the second conveyor passes through the second supply thereof in the second money item receiving portion and transport it to a second exit point.

Such a device having two hopper arrangements increases the storage capacity and payout speed of the device in comparison with conventional single hopper devices. A further advantage of the twin hopper could be that, should one hopper become defective during use, coins can still be returned to a user through operation of the other hopper arrangement. This is in contrast to the limitations of single hopper apparatus.

In a further aspect the invention provides money item dispensing apparatus comprising a first hopper arrangement having a first selectably drivable endless loop conveyor whose path includes a first money item receiving portion, and a first money item store for sequentially feeding a first supply of money items to be dispensed into said first money item receiving portion, the first conveyor having a plurality of receptacles thereon, each of which is adapted to entrain, in use, a money item to be dispensed as the first conveyor passes through the first supply thereof in the first money item receiving portion and transport it to a first exit point, wherein the money item dispensing apparatus comprises sorting means operable to receive a money item and to selectively direct the money item to the first money item store, and wherein said sorting means is further operable to selectively direct the money item to a second money item store associated with a second hopper arrangement.

This apparatus comprising a single hopper arrangement can therefore be capable of being 'upgraded' to an apparatus comprising two hopper arrangements. According benefits are that the manufacturing procedure for twin-hopper devices is greatly simplified since a large component of their design is the singe hopper apparatus. This has obvious cost benefits. An operator of the device also has the additional flexibility of being able to switch between a device having a single hopper arrangement and a device having two hopper arrangements.

Occasionally, money items with an unwanted sticky coating on them are inserted into the acceptor and stick in the acceptor mechanism. Conventionally in such instances, upon realising that the machine has neither accepted nor returned their money item, a user presses a button on the front of the machine that activates an acceptor clearing procedure. This system has the drawback that it relies on a user realising that a money item has become stuck in the mechanism and understanding the steps they must take to free the money item.

The invention seeks to overcome this problem. According to the invention from a further aspect there is provided a money item acceptor comprising a money item rundown path, sensing means for sensing a money item and for providing at least one sensor output signal, motor means for performing a clearance procedure of the rundown path, and processing means operable to determine when the sensor output signal adopts a predetermined value relationship and in response thereto, to provide the first processor output signal to initiate the clearance procedure.

Such a money item acceptor can have the advantage of automatically freeing money items jammed within the device without action being required by a user.

The money item acceptor can further comprise a first sensor for sensing a money item at a first position along the rundown path and for providing a first output signal and a second sensor for sensing a money item at a second position along the rundown path and for providing a second output signal, wherein the processing means determines when the first and second output signals adopt a predetermined value relationship and in response thereto, provides a control signal to initiate the clearance procedure.

According to the invention from a further aspect there is provided a money item conveyor for use in a money item dispensing apparatus, wherein said conveyor is substantially formed in a single moulding.

Forming the conveyor in a single moulding reduces manufacturing costs and minimises the number of components required to form the conveyor thus simplifying the design and minimising the risk of faults occurring in the conveyor mechanism.

In certain circumstances it is required to empty the hopper of all of its contents, for instance at the end of the day when staff are collecting takings. In this case, appropriate signals are provided to a microprocessor in the device to drive the conveyor motor to continually eject money items from the hopper to the money item return tray.

When purging the contents of conventional hoppers, money items, are returned to the return tray and a person collecting the contents of the hopper must position a bag or other such container under the return tray to collect the items. This can prove difficult and time consuming and increases the risk of robbery and fraud since, at the time of leaving the machine, money items are not in a secure container. The current invention seeks to overcome this problem.

According to the invention from a further aspect there is provided a method of purging the money items in a money item dispensing apparatus in a money item-operated machine, the method comprising feeding a money item from a money item source associated with the dispensing apparatus into a receptacle, moving the money item in the receptacle to a position associated with an outlet of the dispensing apparatus, and ejecting the money item through the outlet into a cashbox housed within the machine.

There is further provided money item dispensing apparatus for a money item-operated machine, the apparatus comprising a money item source, a money item receptacle, means for feeding a money item from the money item source into the receptacle, motor means for moving the money item in the receptacle to a position associated with an outlet, means for ejecting the money item from the receptacle through the outlet and via a first path to a money item return tray for a user to collect, and means for ejecting the money item from the receptacle through the outlet and via a second path into a cashbox.

Ejecting money items to a cashbox means that the money items can enter a secure container before leaving the machine. Accordingly, the security risks and hindrance associated with collecting purged money items from the money item return tray of the machine can be overcome.

Filling hopper devices is generally done manually through a money item entry point in the hopper apparatus. This is a time consuming and therefore costly method of filling the hopper, since even when a funnelling device is used, there is a limit to the speed of entry of money items to the hopper, for instance due to the coins jamming in the output of the funnelling device.

According to the invention from a further aspect there is provided filling apparatus for filling a money item dispensing apparatus, the device comprising a money item source, a money item receptacle, means for feeding a money item from the money item source into the receptacle, a money item outlet, motor means for moving the money item in the receptacle to a position associated with the outlet, and ejecting means for ejecting the money item from the receptacle through the outlet, wherein the filling apparatus is adapted to allow a continuous money item path to be formed between the outlet and a money item inlet of the money item dispensing apparatus.

There is further provided a method of filling a money item dispensing apparatus, the method comprising positioning a money item dispensing apparatus filling apparatus in a position associated with the money item dispensing apparatus such that a continuous money item path is formed between a money item outlet of the filling apparatus and a money item inlet of the money item dispensing apparatus, and activating the filling apparatus to refill the money item dispensing apparatus.

There is further provided money item dispensing apparatus comprising means for locating a filling apparatus with said dispensing apparatus to allow a continuous money item path to be formed between a money item outlet of said filling apparatus and a money item inlet of the money item dispensing apparatus.

There is further provided money item dispensing apparatus comprising means for electrically connecting the apparatus to a filling apparatus.

BRIEF DESCRIPTION OF THE DRAWINGS

In order that the invention may be more fully understood, embodiments thereof will now be described by way of example with reference to the accompanying drawings in which.

DETAILED DESCRIPTION

Overview

Figure 1:
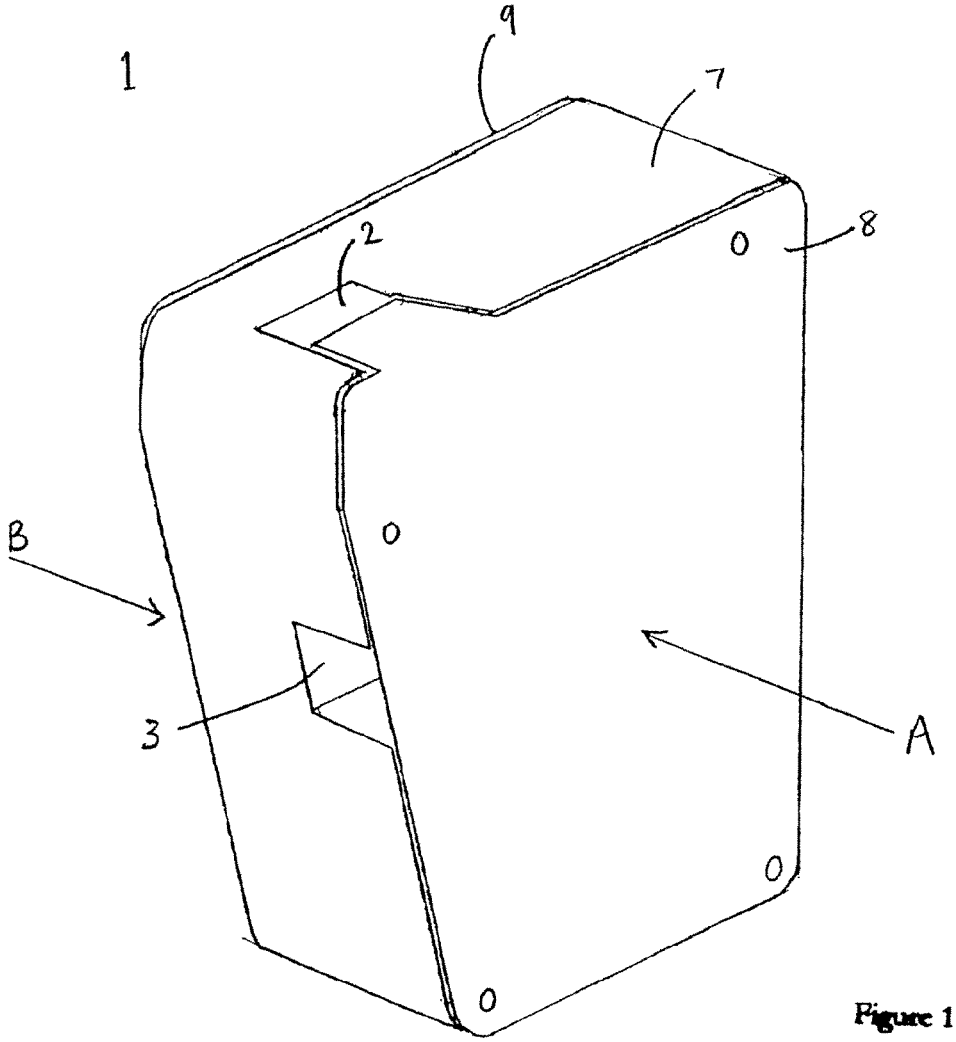
FIG. 1 is an external view of a unified money item acceptor and hopper apparatus according to the invention.

Referring to FIG. 1, an external view of a unified money item acceptor and hopper apparatus 1 according to the invention is illustrated. In this example, the housing of the apparatus 1 is substantially formed in the shape of an irregular pentagonal prism and has a number of external openings, including a money item entry opening 2 and a money item return opening 3. The apparatus 1 has further openings 4, 5 (illustrated in FIG. 2) through which money items can be ejected to one or more cashboxes (not shown) as well as an opening 6 (FIG. 2) into which external data lines can enter the apparatus 1 for connection to the apparatus 1. The mechanism of the apparatus 1 is held within a central portion 7 having a first cover 8 and a second cover 9.

FIGS. 2 to 18 illustrate the unified money item acceptor and hopper apparatus 1 in more detail. The apparatus 1 illustrated in these Figures is also a base component of a unified acceptor and twin hopper apparatus, the twin-hopper apparatus being further illustrated in FIGS. 20 to 23. The single hopper apparatus 1 in the illustrated embodiment can be 'upgraded' to a twin hopper apparatus by the attachment of a single additional component to the single hopper apparatus 1. However, a result is that some of the features of the single hopper apparatus 1 illustrated in FIGS. 2 to 18 are solely for use in the twin-hopper version and are therefore redundant in the single hopper version 1. In embodiments of the invention wherein the single hopper apparatus 1 does not have the 'upgrade' feature, these redundant features can be omitted. This will be explained in more detail with reference to the particular features to which it applies.

Figure 2:
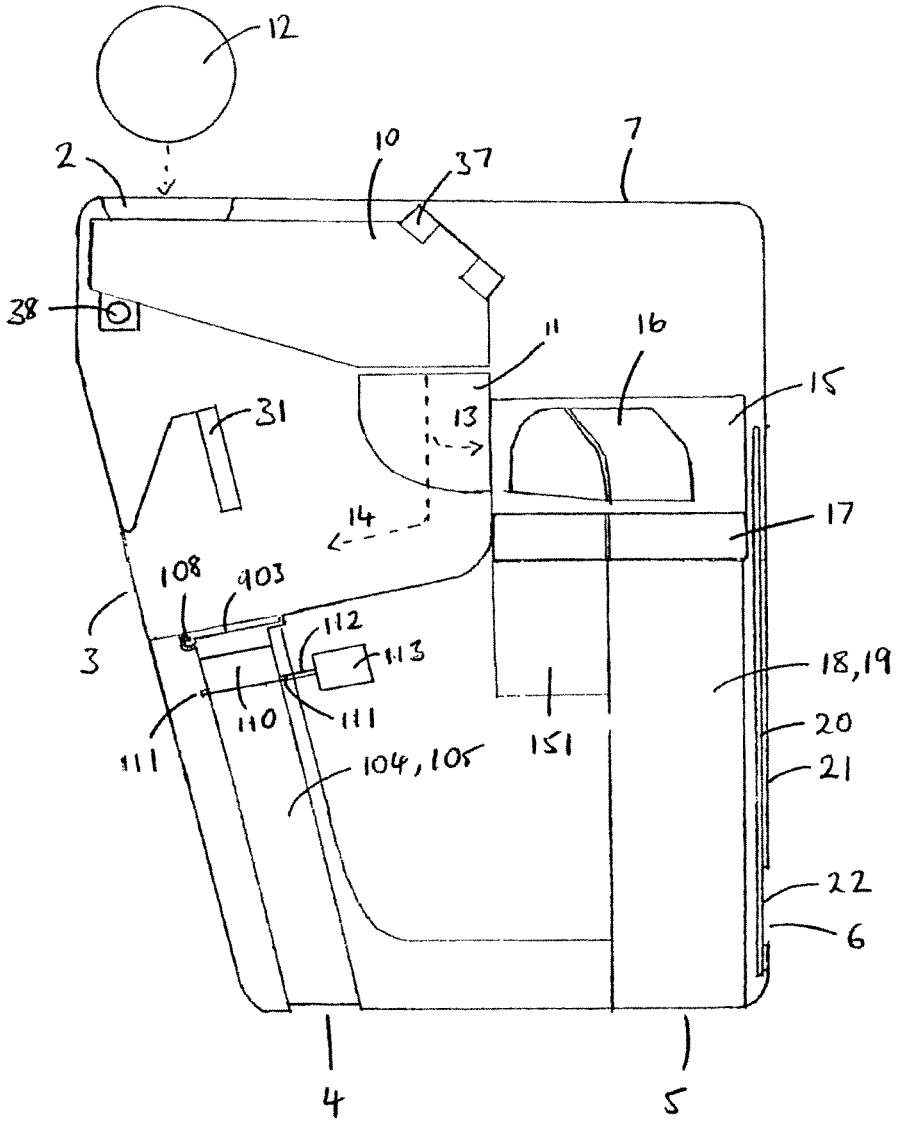
FIG. 2 is an internal view of a portion of a unified money item acceptor and hopper apparatus according to the invention, the view taken from the direction of arrow 'A' in FIG. 1. The Figure is also an internal view of a unified acceptor and twin hopper according to the invention, the view taken from the direction of the arrow 'F' in FIG. 20.

A side view of the central portion 7 of the unified money item acceptor and hopper apparatus 1 is illustrated in FIG. 2, the view taken from the direction of the arrow marked 'A' in FIG. 1. In this example, the central portion 7 includes an acceptor 10, an accept gate 11 operable to direct a money item 12 to an accept path 13 or a return path 14, a sorter 15 including a first sorter gate 16 and a second sorter gate 17, first and second cash box chutes 18, 19, a printed circuit board 20 having a cover 21 and a connector port 22 and a hopper arrangement 23 (shown in FIGS. 3 and 4).

In use, a money item 12 enters the unified money item acceptor and hopper apparatus 1 via the money item entry opening 2. Once through the entry opening 2 the money item 12 enters the money item acceptor 10. The money item acceptor 10 comprises a microcontroller which determines from the output of a plurality of sensors within the acceptor 10 whether the entered money item 12 is likely to be counterfeit. If so, a signal is provided to an accept gate solenoid driver to cause the accept gate 11 to direct the money item 12 via the return path 14 to the money item return opening 3, following ejection of the money item 12 from the acceptor 10. Conversely, if the money item 12 is found to be genuine, a signal is provided to the accept gate solenoid driver to cause the accept gate 11 to direct the money item 12 via the accept path 13 into the sorter 15.

The unified money item acceptor and hopper apparatus 1 comprises processing means operable to determine whether the entered money item 12 is to be directed from the sorter 15 to the hopper arrangement 23 or to one of first and second cashboxes 24, 25 (illustrated in FIGS. 18*a* and 18*b*), via the first or second cash box chutes 18, 19 respectively. In this example, the processing means receives a signal from a sensor in the hopper arrangement 23 indicating the number of money items 12 in the hopper 23. An inputted money item 12 is directed to one of the first and second cashboxes 24, 25 in the case that the hopper arrangement 23 is full, but otherwise the money item 12 is directed to the hopper arrangement 23. Once the destination of the money item 12 has been determined, appropriate signals are provided to control the first and second sorter gates 16, 17 such as to direct the money item 12 to one of the first and second cashboxes 24, 25 via one of the first and second cashbox chutes 18, 19 respectively, or to the hopper arrangement 23. In this example, if it is determined that money items 12 should be directed to a cashbox, they are primarily directed to the first cashbox 24. However, once a certain predetermined number of money items 12 have been directed to the first cashbox 24 following emptying of the first cashbox 24, subsequent money items will be directed to the second cashbox 25.

Figure 3:
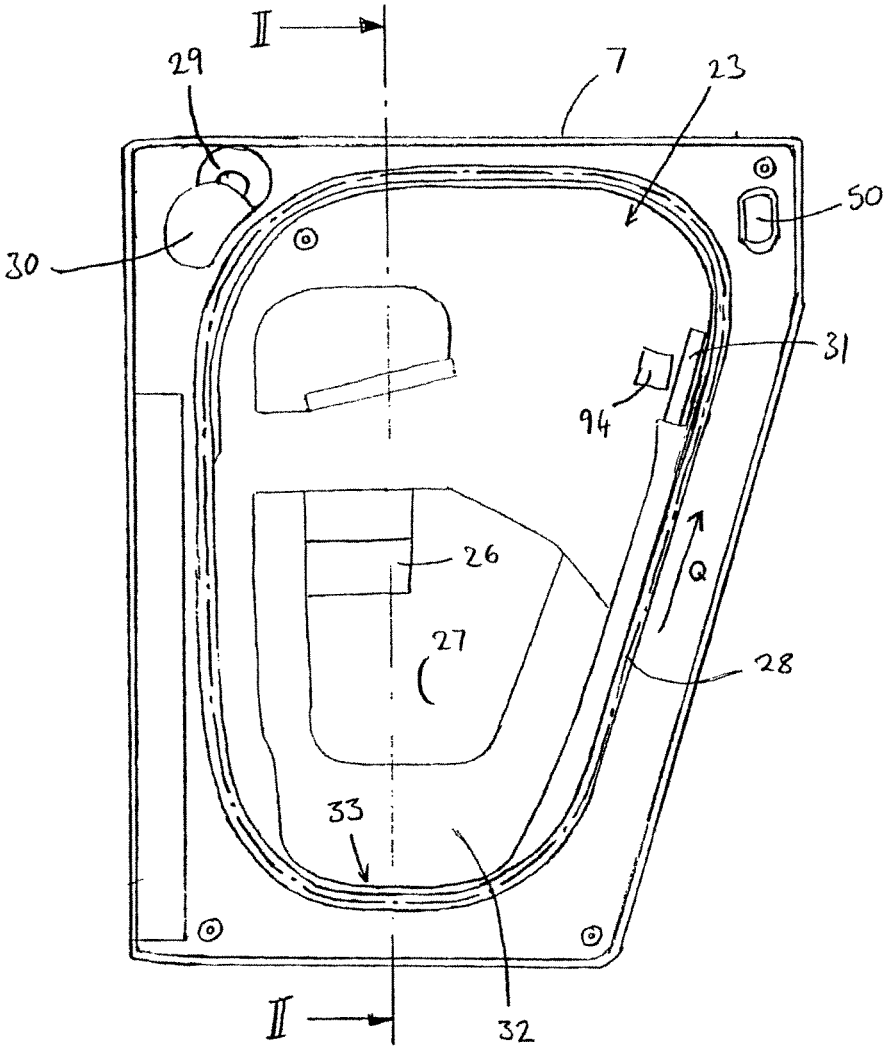
FIG. 3 is a cross sectional view of the mechanism of FIG. 4 taken along the line I-I thereof.
Figure 4:
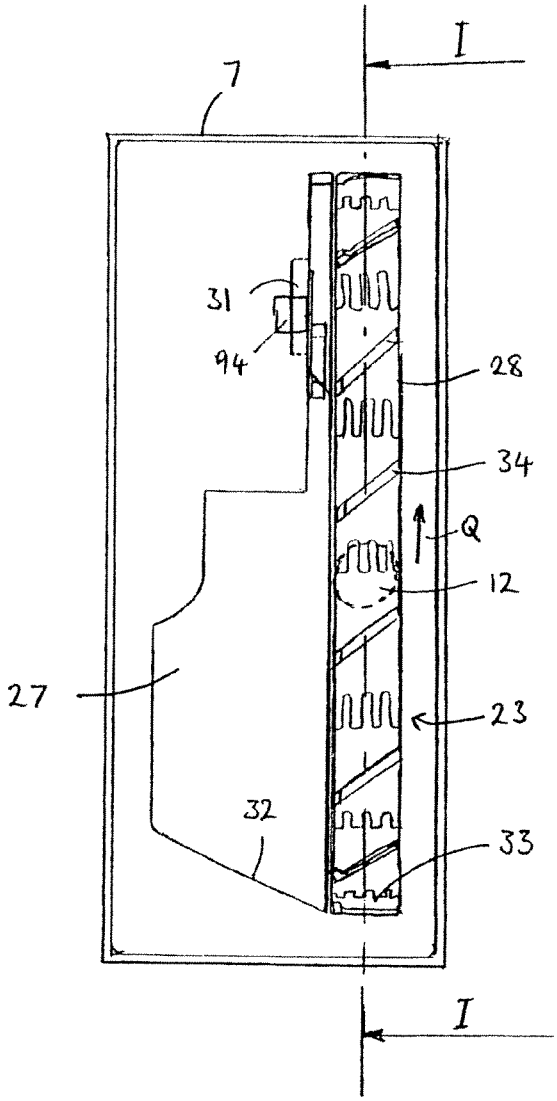
FIG. 4 is a cross-sectional view of a portion of a unified money item acceptor and hopper apparatus according to the invention taken along the line II-II of FIG. 3, and viewed from the direction of arrow B in FIG. 1. The Figure is also a cross-sectional view of a first portion of a unified acceptor and twin hopper apparatus according to the invention, the view taken from the direction of arrow 'G' in FIG. 20.

FIG. 3 is a cross sectional view of the central portion 7 of the unified money item acceptor and hopper apparatus 1 of FIG. 1, the view taken through line I-I of FIG. 4 and the view being from the direction of the arrow marked 'B' in FIG. 1. This side of the central portion 7 comprises a hopper arrangement 23 including a hopper inlet 26, a hopper store 27, a conveyor 28, a conveyor motor 29 having conveyor gearing means 30 and a money item outlet 31. The hopper operates generally as that described in EP-A-0080842. An accepted money item 12 passes through the gate arrangements 16, 17 shown in FIG. 2, and enters the hopper via the money item inlet 26 shown in FIG. 3. The money item 12 then drops into the hopper store 27. The hopper store 27 has a base 32 that is downwardly inclined such that money items 12 in the hopper store 27 tend to move due to gravity towards inner side 33 of the conveyor 28. The conveyor 28 is selectably driven in the direction 'Q' by the conveyor motor 29. The conveyor 28 comprises on its inner surface a plurality of lips 34 (see FIG. 4) which are arranged to form money item receptacles. If payout of one or more money items 12 is required, the conveyor 28 is driven. Money items 12 move from the store 27 towards a portion of the inner side of the conveyor 28, this being a money item receiving portion 33 of the conveyor 28, and are held in receptacles formed by the lips 34 on the conveyor surface. A money item 12 to be paid to a user is therefore entrained towards the money item outlet 31 on the conveyor 28 and upon reaching the money item outlet 31 the money item 12 is ejected through the outlet 31.

Referring again to FIG. 2, the money item 12 ejected from a receptacle of the conveyor 28 emerges through the hopper outlet 31 and joins the return path 14 leading to the money item return opening 3 and to a money item collection tray (not shown) for a user to collect.

Operation

The operation of the unified acceptor and hopper apparatus 1, following insertion of a coin 12 into the opening 2, will now be described in detail with reference to FIGS. 1 to 19.

Figure 5:
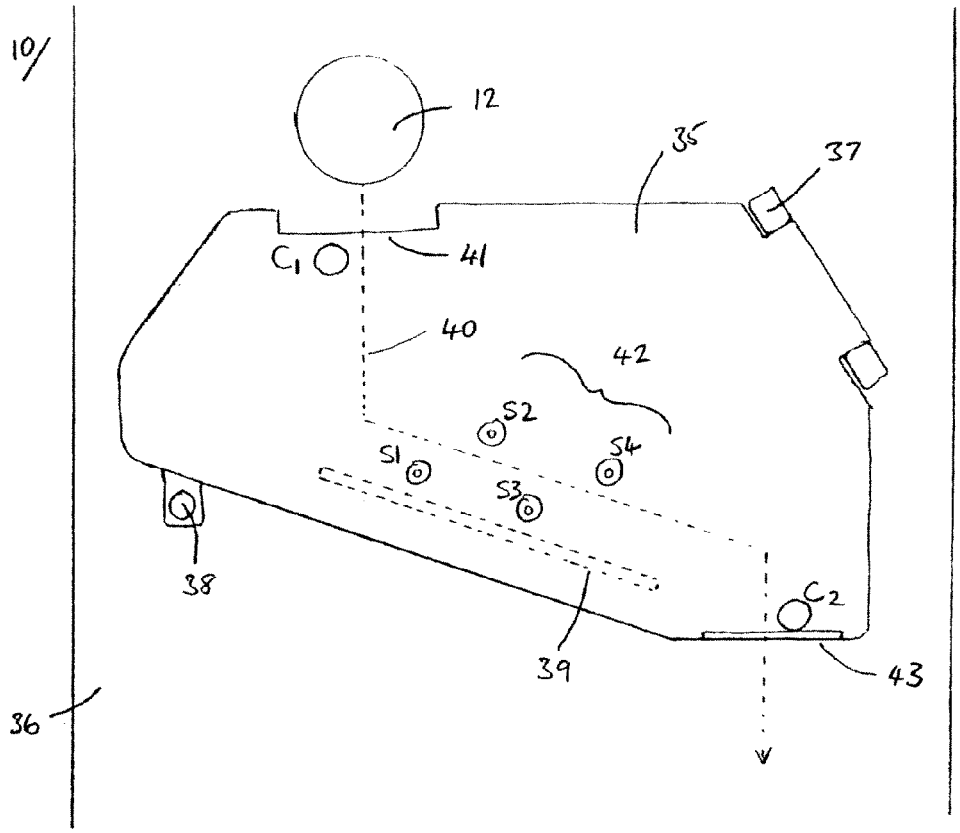
FIG. 5 is an illustration of a money item acceptor according to the invention.

The coin 12 passes from the opening 2 to the money item acceptor 10, which is illustrated in more detail in FIG. 5. The acceptor 10 comprises a generally plate-like main body 35 that is positioned adjacent to a surface 36 of the central portion 7 of the apparatus 1. The main body 35 is connected to the surface 36 by hinging means 37 and is also held at a point on the main body 35 diagonally opposite the hinging means 37 by an arm 38 connected to an acceptor clearance solenoid (not shown). The main body 35 includes a shelf 39 that protrudes from the main body 35 in the direction of the surface 36 such that it substantially abuts the surface 36. This results in a gap between the main body 35 and the surface 36 and a money item run-down path 40 is formed along which money items 12 under test pass edgewise from an inlet 41 of the acceptor 10 along the shelf 39 which leads the coin through a money item sensing station 42 and then to an outlet 43.

Figure 6:
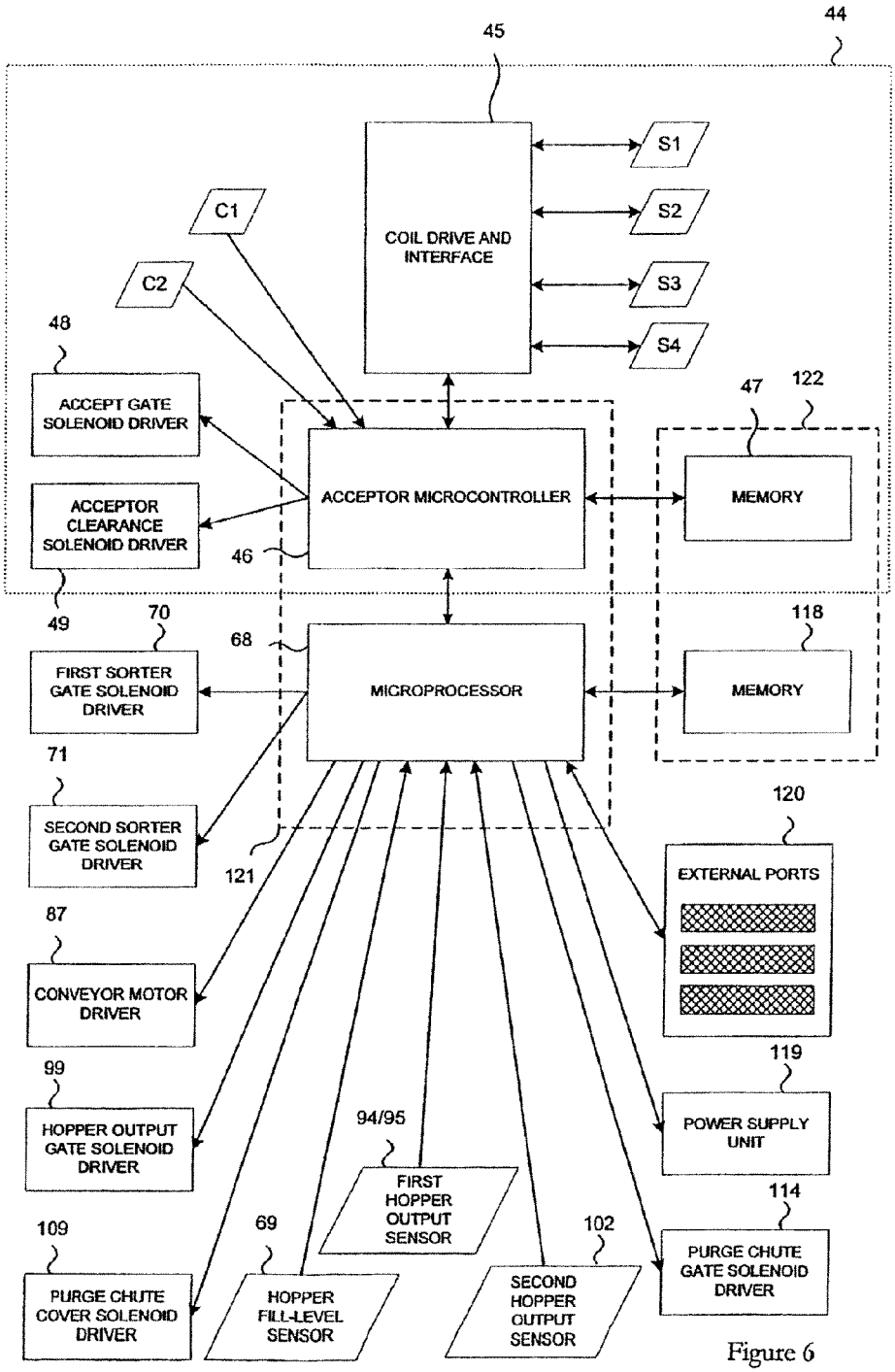
FIG. 6 is a schematic block diagram of the circuitry of a unified hopper and acceptor according to the invention.

The money item acceptor 10 is capable of validating a number of money items of different denominations, including bimet coins, for example the Euro coin set and the UK coin set including the bimet £2.00 coin. A test is performed on each money item as it passes through the sensing station 42. The money item sensing station 42 includes four money item sensing coil units S1, S2, S3 and S4, which are energised in order to produce an inductive coupling with the coin 12. FIG. 6 is a schematic illustration of the circuitry of a unified money item acceptor and hopper apparatus 1. The components circumscribed by a dotted box 44 are associated with the acceptor 10. The coils S1 to S4 of the acceptor 10 are energised at different frequencies by a drive and interface circuit 45. Eddy currents are induced in the money item under test by the coil units. The different inductive couplings between the four coils S1 to S4 characterise the money item substantially uniquely. The drive and interface circuit 45 produces corresponding digital money item parameter data signals x1, x2, x3, x4, as a function of the different inductive couplings between the money item and the coil units S1, S2, S3 and S4. The coil units S have a small diameter in relation to the diameter of money items under test in order to detect the inductive characteristics of individual chordal regions of the money item. Improved discrimination can be achieved by making the area A of the coil unit S which faces the money item, such as the coil S1, smaller than 72 $mm^2$, which permits the inductive characteristics of individual regions of the money item's face to be sensed. However, the invention is not restricted to any particular coil size and larger coils may be used to couple with the entire surface of the money item.

The sensor coil units S each include one or more inductor coils connected in an individual oscillatory circuit and the coil drive and interface circuit 45 includes a multiplexer (not shown) to scan outputs from the coil units sequentially, so as to provide data to an acceptor microcontroller 46. Each circuit typically oscillates at a frequency in a range of 50-150 kHz and the circuit components are selected so that each sensor coil S1-S4 has a different natural resonant frequency in order to avoid cross-coupling between them.

As a money item under test passes the sensor coil unit S1, its impedance is altered by the presence of the coin over a period of ~100 milliseconds. As a result, the amplitude of the oscillations through the coil is modified over the period that the coin passes and also the oscillation frequency is altered. The variation in amplitude and frequency resulting from the modulation produced by the coin is used to produce the money item parameter signals $X_1$, $-X_4$ representative of characteristics of the coin.

In order to determine money item authenticity, the money item parameter signals produced by a money item under test are fed to the acceptor microcontroller 46 which is coupled to a memory 47. The microcontroller 46 processes the money item parameter signals $X_1$, $-x_4$ derived from the money item under test and compares the outcome with corresponding stored values held in the memory 47. According, if the coin 12 under test is indicated to be acceptable a signal is provided to an accept gate solenoid drive circuit 48 which operates the accept gate 11 shown in FIG. 2 so as to allow the money item to pass to the accept path 13. Otherwise, the accept gate solenoid drive circuit 48 is provided with a signal causing the accept gate 11 to direct the coin 12 to the return path 14.

Jam Releasing Mechanism

Sensing means can be provided within the acceptor 10 to determine when a money item has jammed within the mechanism of the acceptor 10. Jamming may occur when a money item having an unwanted sticky coating on it, for instance beer, is inputted and sticks in the acceptor mechanism. The sensing means could comprise the coils S1 to S4, their outputs being used to determine when a coin has become stationary and hence jammed in the acceptor 10. Alternatively, one or more sensors may be incorporated into the acceptor 10 for the purpose of detecting jammed money items.

In the example illustrated in FIG. 5, sensors C1 and C2 coupled to the acceptor microcontroller 46 (see FIG. 6) are located at positions along the money item rundown path 40 and are used to sense money items entering and leaving the acceptor 10 so as to determine whether a money item has become jammed in the acceptor 10. Sensor C1 detects money items entering the acceptor 10. If sensor C2 does not detect a money item leaving the acceptor 10 within a period of, for instance, 5 seconds from it being detected entering the acceptor 10, an acceptor clearing procedure is activated. In this example, the acceptor clearing procedure involves the microcontroller 46 determining that the money item has not been sensed by coil C2, in which case the microcontroller 46 produces a jam clearance signal, which activates an acceptor clearance solenoid driver 49 (see FIG. 6). In response to the signal the solenoid driver 49 drives a servomotor 50 (see FIG. 3) to move the arm 38 to pivot the main body 35 of the acceptor 10 about the hinge 37 so as to widen the money item rundown path 40. This is done to free the jammed money item from the acceptor so that it may fall out of the acceptor 10 and enter the money item return path 14.

Referring again to FIG. 2, if the coin 12 becomes jammed in the acceptor 10 it is released automatically through initiation of the acceptance clearance procedure and is returned to the user via the money item return path 14. Alternatively, if the coin 12 does not jam in the acceptor 10, it leaves the acceptor 10 via the acceptor outlet 43 and is directed by the accept gate 11 to the accept path 13 or return path 14, in accordance with whether or not the coin 12 was found to be genuine by the acceptor microcontroller 46.

Accept Gate

Figure 7:
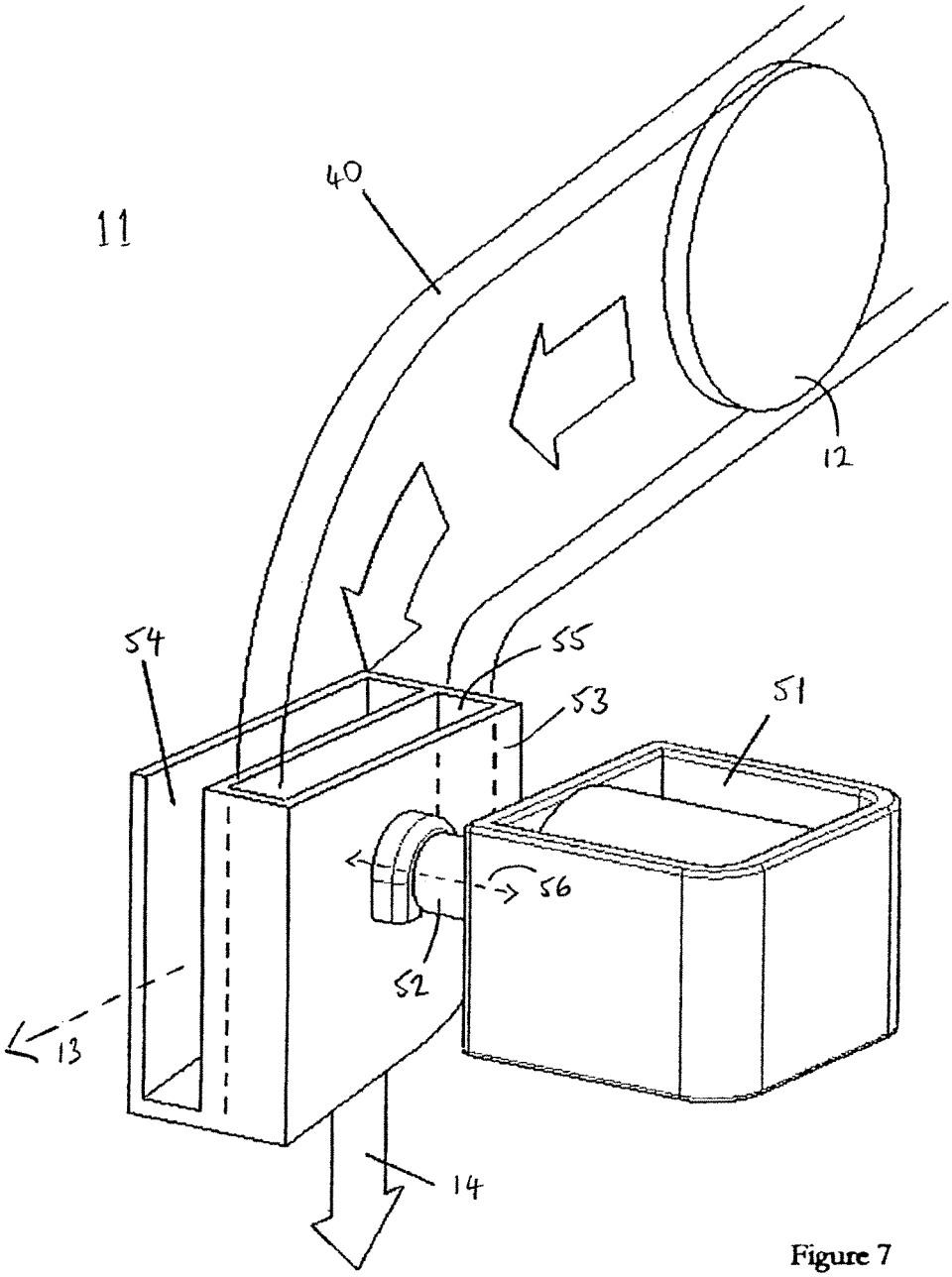
FIG. 7 is an illustration of a solenoid activated accept gate, the solenoid illustrated being activated to cause a money item to be directed to a return path.
Figure 8:
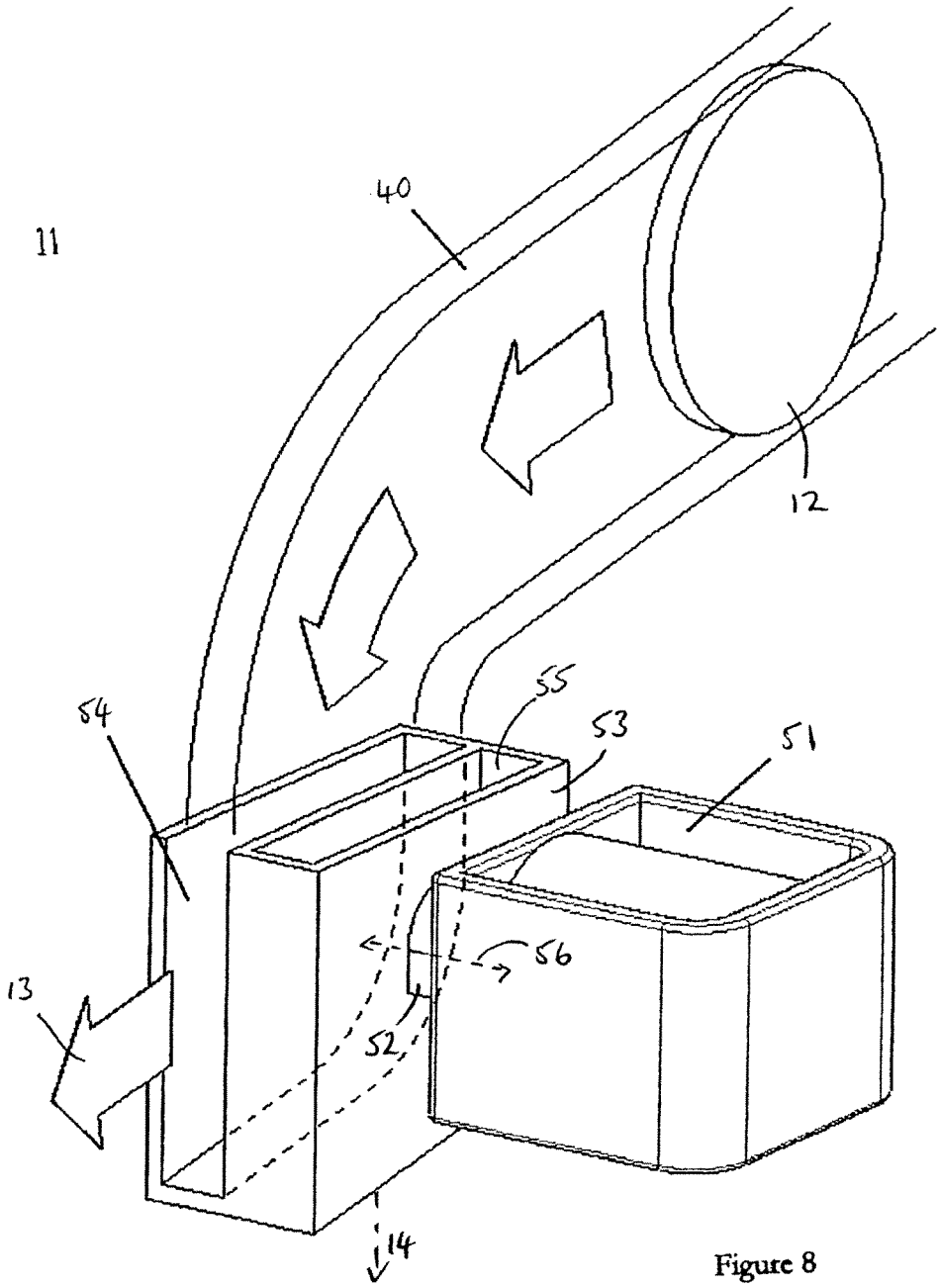
FIG. 8 is an illustration of a solenoid activated accept gate, the solenoid illustrated being activated to cause a money item to be directed to an accept path.

FIG. 7 is an illustration of the accept gate 11 from the rear as compared with FIG. 2. The accept gate 11 comprises an accept gate solenoid 51 coupled via an acceptor gate arm 52 to a channelling member 53 including an accept channel 54 and a return channel 55 to be coupled to the accept path 14 and the reject path 13 respectively. The coin 12 passes down the coin rundown path 40 of the acceptor 10 and enters one of the accept channel 54 and return channel 55. To determine which channel the coin 12 enters, the acceptor gate arm 52 is operable to move the channelling member 53 under the control of the accept gate solenoid 51 back and fourth in the direction of the dotted arrows 56 such as to align the accept channel 54 with the coin rundown path 40 in the case that the coin 12 is found to be genuine, or to align the return channel 55 with the coin rundown path 40 in the case that the coin 12 is found to be counterfeit. FIG. 7 illustrates the acceptor gate arm 52 in its extended position which aligns the coin rundown path 40 with the return channel 55 and the coin 12 is channelled out of the channelling member 53 in the direction of the return path 14 from which it exits the unified money item acceptor and hopper apparatus 1 via the money item return opening 3 and is returned to a user via a return tray (not shown). FIG. 8 illustrates the alternative situation in which the acceptor gate arm 52 is retracted and thus the accept channel 54 is aligned with the coin rundown path 40 and hence the coin 12 is channelled out of the channelling member 53 in the direction of the accept path 13.

Referring to FIG. 6, in the situation in which the coin 12 is found to be genuine, the acceptor microcontroller 46 provides an appropriate signal to the accept gate solenoid driver 48 which drives the accept gate solenoid 51 to retract the acceptor gate arm 52 and hence move the channelling member 53 so as to direct the coin 12 via the accept path 13 to the sorter 15.

Sorter Gates

Figure 9:
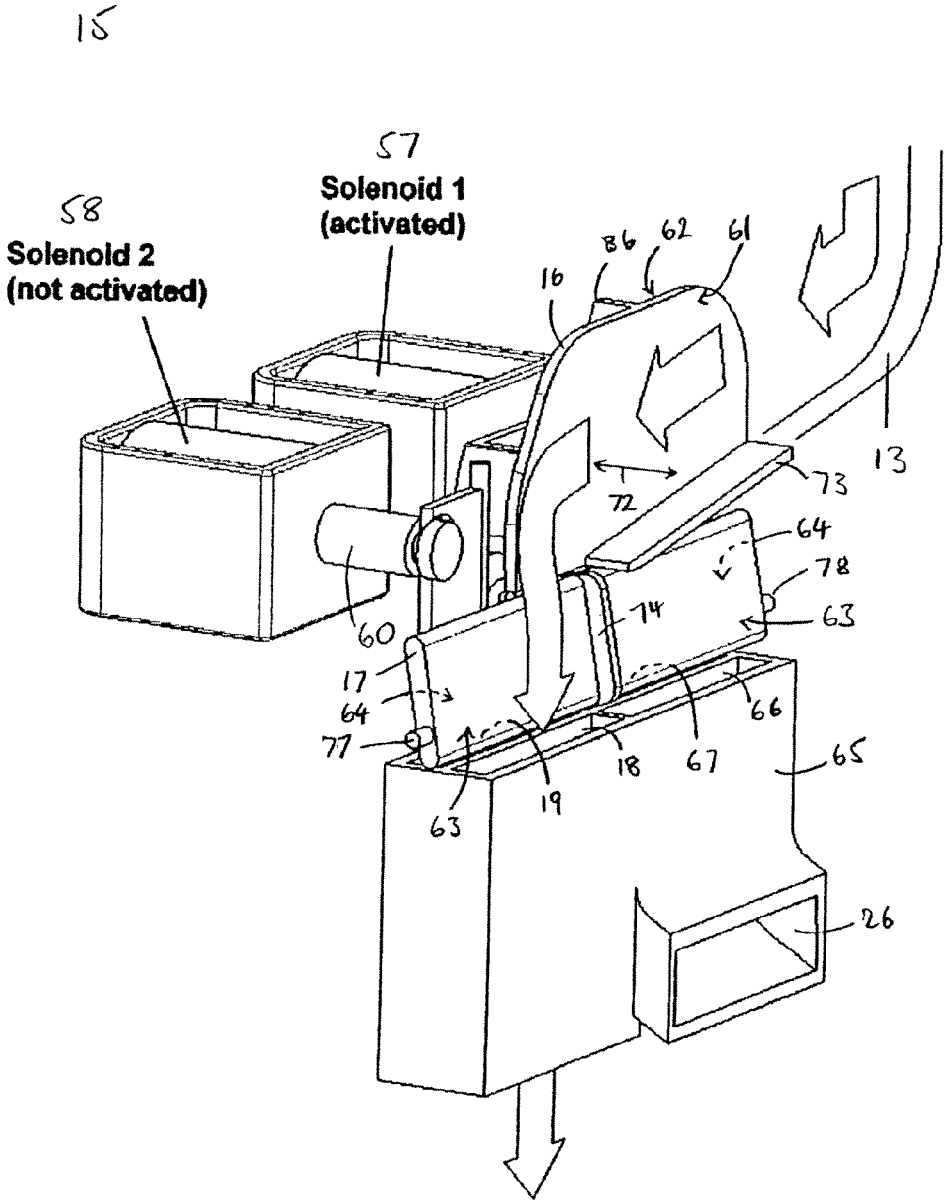
FIG. 9 is an illustration of a sorter having first and second sorter solenoid activated gates, the solenoids illustrated being activated to direct a money item via a first cashbox chute to a cashbox.

A first illustration of the first and second sorter gates 16, 17 of the unified money item acceptor and hopper apparatus 1 is depicted in FIG. 9 and comprises first and second sorter gate solenoids 57, 58 connected to the first and second sorter gates 16, 17 via first and second sorter arms 59 (shown in FIG. 11), 60 respectively. The first sorter gate 16 comprises a cashbox channel 61 and a hopper channel 62. The second sorter gate 17 comprises a first channelling face 63 and a second channelling face 64. A chuting member 65 comprises four sorter chutes, these being first and second hopper chutes 66, 67 and first and second cashbox chutes 18, 19 (which may alternatively be a single cashbox chute) into which money items may be directed depending on the position of the first and second sorter gates 16, 17. However, the unified money item acceptor and hopper apparatus 1, having only one hopper arrangement 23 does not in this example make use of the second hopper chute 67, which is for use in the twin hopper apparatus further illustrated in FIGS. 20 to 23. The second hopper chute 67 may be omitted entirely.

Figure 11:
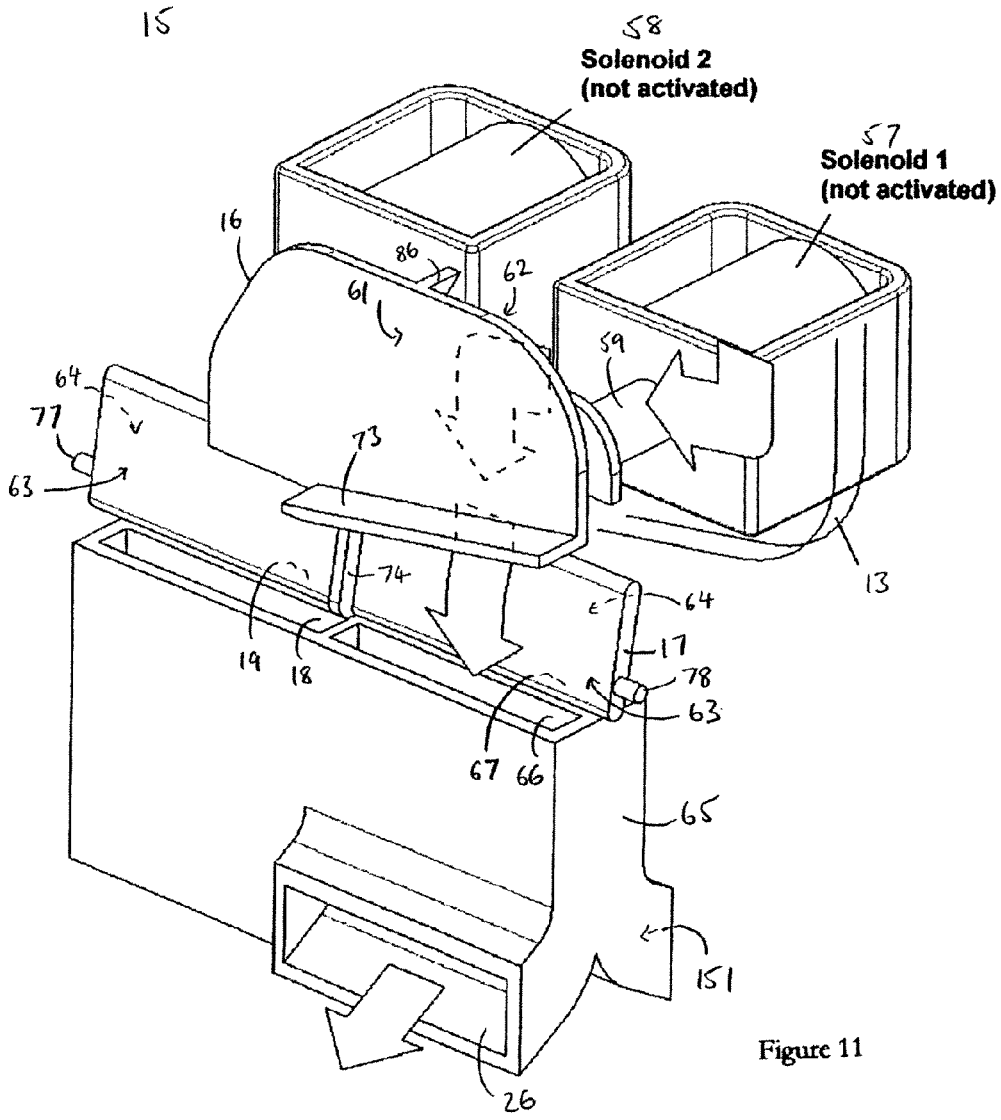
FIG. 11 is an illustration of a sorter having first and second sorter solenoid activated gates, the solenoids illustrated being activated to direct a money item via a first hopper chute to a hopper arrangement.
Figure 12:
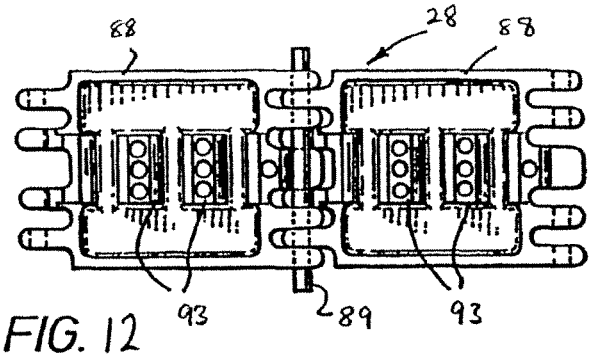
FIG. 12 is a plan view of the track-side of segments of a conveyor.
Figure 13:
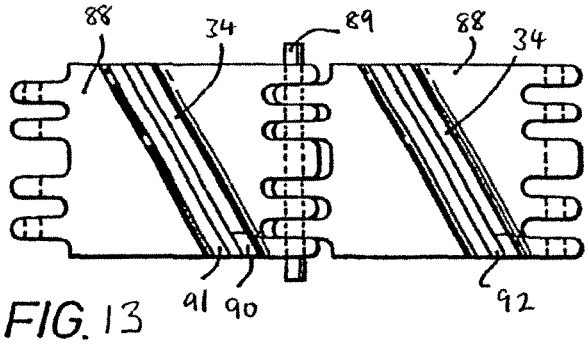
FIG. 13 is a plan view of the lip-side of a section of a conveyor.

Referring to FIG. 6, the apparatus 1 has a microprocessor 68 operable to determine to which sorter chute 66, 67, 18, 19 the coin 12 should be directed. In this example, the microprocessor 68 receives a signal from a sensor 69 in the hopper store 27 providing an indication of the number of money items 12 in the hopper store 27. The microprocessor 68 is operable to determine from the received signal whether or not the hopper store 27 is full and to provide appropriate signals to the first and second sorter gate solenoid drivers 70, 71 to drive the first and second sorter gate solenoids 57, 58 respectively in a manner to be described and to direct the coin 12 accordingly. If the hopper store 27 is full, the coin 12 is directed to the first or second cashbox chutes 18, 19. In the case that the hopper store 27 is not full, the coin 12 is directed to the first hopper chute 66 (as depicted in FIG. 11) leading to the hopper arrangement 23.

In an alternative embodiment the hopper arrangement 23 is used to receive, store and return two denominations of coins and the first and second cashbox chutes 18, 19 are therefore used so that, when the hopper store 27 is full, entered coins may be directed via either of the first 18 and second 19 cashbox chutes to one of first and second cashboxes 24, 25 respectively according to their denomination, which in this example is determined by the acceptor microcontroller 46 and indicated to the microprocessor 68. In alternative embodiments both cashbox chutes 18, 19 may lead to the same cashbox for receiving a single or multiple denominations of coin, or one or other of the first and second cashbox chutes 18, 19 may be omitted entirely.

Referring to FIG. 9, the first sorter gate 16 is operable to move in the direction of the arrow 72 under the control of the first sorter gate solenoid 57. The cashbox channel 61 is defined by a first shelf 73 protruding from the plane of the first sorter gate 16 on the side of the gate comprising the cashbox channel 61, along which money items pass edgewise so as to bypass the first and second hopper chutes 66, 67. When coins reach the end of the shelf 73 they drop, in this example due to gravity, down one of the first and second cashbox chutes 18, 19 depending on the position of the second sorter gate 17. FIG. 9 illustrates the sorter arrangement 15 wherein the first sorter gate solenoid 57 has been activated such that the first sorter arm 59 is retracted in order to cause the cashbox channel 61 of the first sorter gate 16 to be aligned with the accept path 13 from the accept gate 11. The cashbox channel 61 directs money items to one of the first and second cashbox chutes 18, 19 according to the position of the second sorter gate 17.

Figure 10:
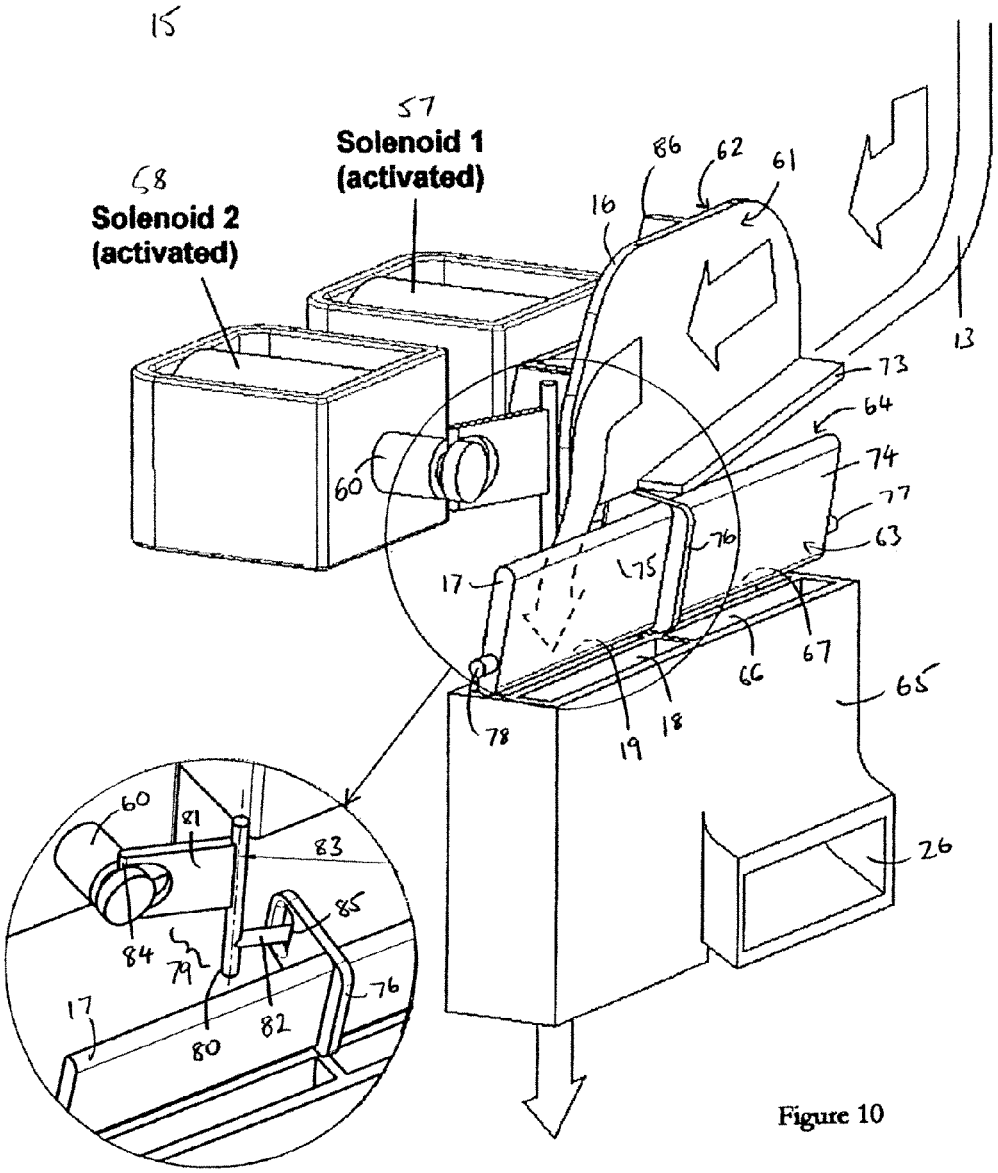
FIG. 10 is an illustration of sorter having first and second sorter solenoid activated gates, the solenoids illustrated being activated to direct a money item via a second cashbox chute to a cashbox.

Referring to FIG. 10, the second sorter gate 17 is formed by two substantially rectangular plates 74, 75 aligned side-by-side, connected to and separated by a dividing plate 76, the three plates being disposed in a cruciform arrangement. The second sorter gate 17 is pivoted about first and second lugs 77, 78, held in receiving sockets (not shown) in the apparatus 1. Referring to the expanded illustration of the circumscribed portion in FIG. 10, the second solenoid arm 60 is hingedly connected to a translational member 79. The translational member 79 comprises a vertically pivoted shaft 80, a flag portion 81 and an actuating lever 82. The flag portion 81 is a rectangular plate connected along a first side to a portion of the length of the shaft 80. The flag portion 81 extends in a direction perpendicular to the turning axis 83 of the shaft 80 and is hingedly connected at a second side opposite to the first side to the second solenoid arm 60 by a pin 84. The actuating lever 82 also connects to the shaft 80 and extends in a direction perpendicular to the turning axis 83 of the shaft 80 and opposite to the direction in which the flag portion 81 extends. The actuating lever 82 engages with a hole 85 in the dividing plate 76. The translational member 79 thus converts the movement of the second sorter arm 60 to a rotational movement about the turning axis 83 of the shaft 80. This rotational movement is used, via the actuating lever 82, to move the second sorter gate 17 to one of its two respective positions. The second sorter gate 17 is weighted such that it reverts to a position in which it directs money items to the first hopper chute 66 or first cashbox chute 18 in the case that the second sorter gate solenoid 58 fails.

In the example of FIG. 9, the second sorter gate solenoid 58 is activated so that the second sorter arm 60 is extended in order to cause the first channelling face 63 of the second sorter gate 17 to be aligned with the cashbox channel 61 of the first sorter gate 16 and therefore with the accept path 13. This causes the inserted coin 12 to be directed to the first cashbox chute 18.

An alternative situation is depicted in FIG. 10 wherein the second sorter gate solenoid 58 is activated such that the second sorter arm 60 is retracted in order to cause the second channelling face 64 of the second sorter gate 17 to be aligned with the cashbox channel 61 of the first sorter gate 16 and therefore with the accept path 13. This causes the inserted coin 12 to be directed to the second cashbox chute 19.

Figure 22:
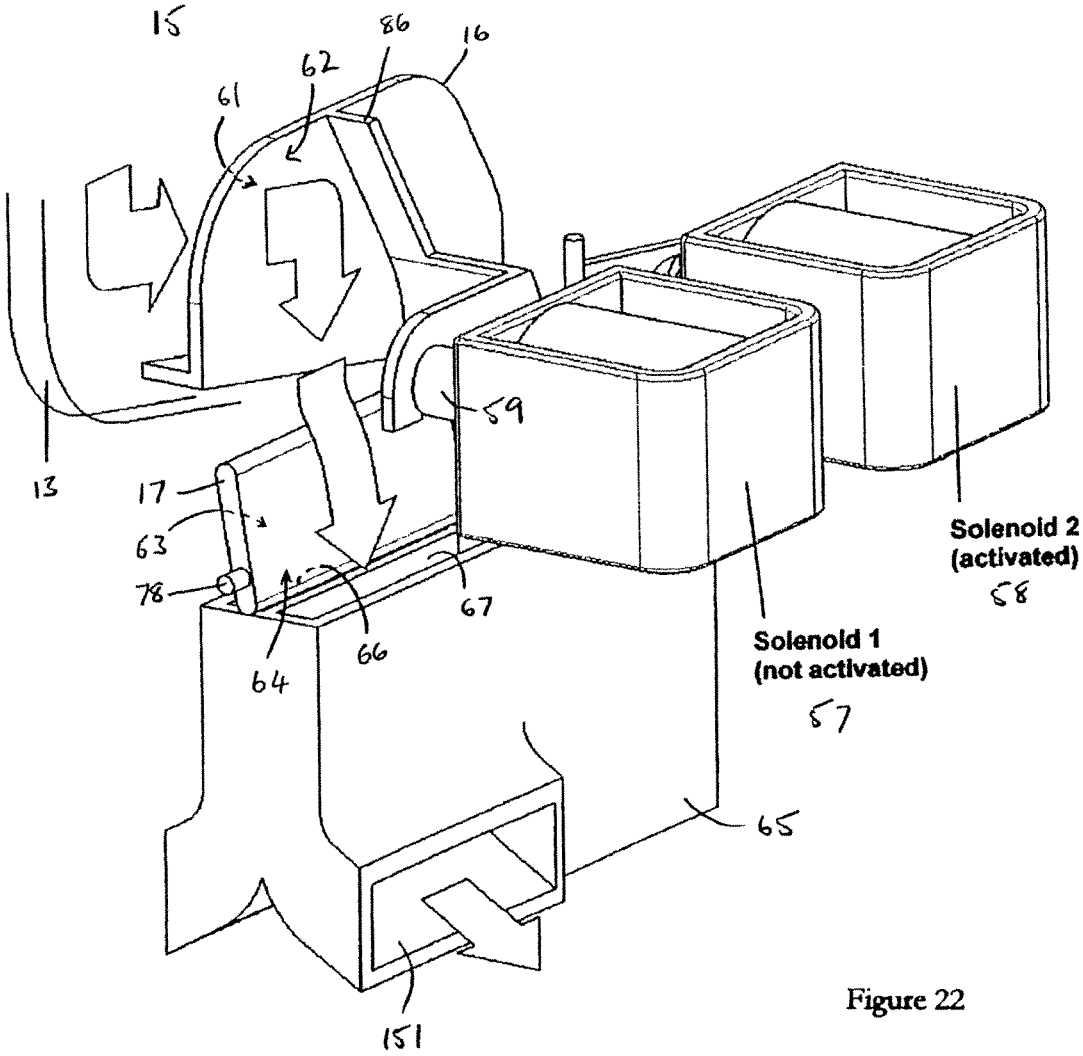
FIG. 22 is an illustration of a sorter having first and second sorter solenoid activated gates, the solenoids illustrated being activated to direct a money item via a second hopper chute to a hopper arrangement.

Another alternative situation, is depicted in FIG. 11 wherein the first sorter gate solenoid 57 is activated such that the first sorter arm 59 is extended in order to cause the hopper channel 62 of the first sorter gate 16 to be aligned with the accept path 13 from the accept gate 11. The hopper channel 62 is defined by a second shelf 86 protruding perpendicularly from the plane of the first sorter gate 16 on the side of the gate comprising the hopper channel 62, to direct money items down to the first or second hopper chutes 66, 67 according to the position of the second sorter gate 17. The second shelf 86 in this example also provides means for connecting the first sorter arm 59 to the first sorter gate 16 (as illustrated in FIG. 22). In the example depicted in FIG. 11, the second sorter gate solenoid 58 is activated such that the second sorter arm 60 is extended in order to cause the first channelling face 63 of the second sorter gate 17 to be aligned with the hopper channel 62 of the first sorter gate 16 and therefore with the accept path 13. This causes the inserted coin 12 to be directed via the first hopper chute 66 into the hopper arrangement 23.

In the hopper arrangement 23 (depicted in FIG. 3) the coin 12 enters the hopper store 27 and if payout of one or more money items is required, the conveyor 28 is driven in the direction 'Q'. The conveyor is driven by the conveyor motor 29 which is driven by a conveyor motor driver 87 controlled by the microprocessor 68 within the unified money item acceptor and hopper apparatus 1 (see FIG. 6). The coin 12 to be paid to a user is held in a receptacle formed by a lip 34 on the surface of the conveyor 28 and is entrained towards the money item outlet 31 on the conveyor 28 and ejected through the outlet 31.

The Conveyor

Figure 14:
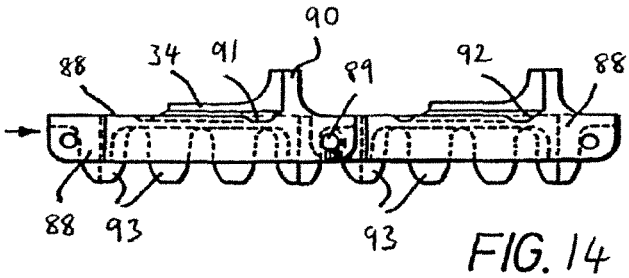
FIG. 14 is a side view of a section of a conveyor.
Figure 15:
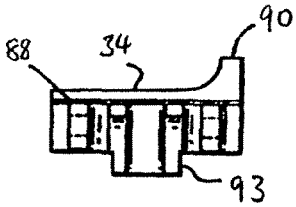
FIG. 15 is an end view of a section of the conveyor of FIG. 14, the view being from the direction of arrow 'C in FIG. 14.

The operation of the conveyor 28 will now be described in more detail with reference to FIGS. 12 to 15. The conveyor 28 is formed by a plurality of hingedly connected segments 88. Referring firstly to FIG. 14, the segments 88 are connected together by means of pivot pins 89 and each comprises a money item pick-up lip 34, which is arranged to form a receptacle to receive a money item and thus entrain the money item towards the hopper outlet 31. Each pick-up lip 34 extends obliquely across the width of the segment 88 from one corner thereof to a point approximately midway along the opposite side of the segment 88. An upstanding projection 90 which acts, in use, as a stirrer in a manner to be described is formed at one end of each lip 34 and a recess 91 is formed in the upper surface of the conveyor segment 88 adjacent the lip 34, a chamfered edge 92 being formed at the junction between the bottom of the recess 91 and the lip 34. As can be seen from the drawings, the lips 34 extend parallel to each other. The underside of each conveyor segment 88 is formed with a plurality of downwardly projecting teeth 93 which mesh with a drive wheel driven by the motor.

The conveyor segments 88 are connected together by means of the hinge pins 89 to form an endless loop. The pins are fitted in and slide along a track formed in a pair of spaced side plates, the conveyor being driven round said track by the engagement of the gear wheel with the teeth 93 on the outside of the loop conveyor.

Referring again to FIG. 4, the mouth of the hopper bottom 32 opens directly onto a money item receiving portion 33 of constant radius at the bottom of the conveyor loop so it can be seen that coins in the hopper store 27 will automatically fall under gravity down the inclined hopper bottom 32 and on to the inside surface of the conveyor 28. The advantage of this arrangement, i.e. feeding to the inside of a closed loop conveyor 28, is that all the area along-side the conveyor 28 and more importantly, most of the area inside it, can be utilised to house coins. Thus a very large capacity coin store is provided in a very compact space.

Due to the distance between the conveyor lips 34 being less than the sum of the diameters of two coins and because of the stirrer 90, even if 2 coins are resting on each other in the lower corner of a conveyor segment 88 as it starts its upward travel, within a very short space of time, the top coin is forced to roll sideways initially and thereafter slides off the lip 34 leaving only one coin thereon as desired.

Chamfered edge 92 is used to unstick any coins from the conveyor 28 should they have become attached thereto due to them being soaked in beer for instance. As the conveyor 28 starts to rise, a coin will tend to slide down onto the lip 34 and as it does so, it will be pushed outwardly by the chamfered edge 92. This also serves to push outwardly any other coin resting on top of the coin to be paid out whereby it falls off the lip onto the next available lip beneath it.

The action of the stirrers 90 is to prevent groups of random coins in the money item receiving portion 33 from forming into 'rolls' extending across the width of the conveyor 28. This 'rolling' is a very common phenomenon in coin handling and it should be avoided because it means that the coins end up vertically aligned and therefore they tend to roll along the conveyor 28 instead of falling over and dropping into the spaces between the lips 34.

In the illustrated embodiment, all the corner radii of the conveyor track are the same which means that at no point on its path can the conveyor 28 grip and retain a coin between two adjacent lips 34 thereby forming a pinch point. If this were to happen, the conveyor 28 might jam and the motor 29 might burn out. Whilst the avoidance of pinch points in the money item receiving portion 33 is of importance, it is also necessary that there is no risk of the conveyor 28 jamming on the uppermost part of its path after the coins have been fed off via exit 31. If the upper radii were not appropriately dimensioned to avoid jamming, a sticky coin could attach itself to the conveyor 28 and therefore not be able to roll off into the exit 31. It would then continue round with the conveyor 28 until it reached the first upper band and jamming would occur. With the illustrated arrangement, this is prevented since, as the conveyor goes round the upper bend, its segments articulate, thereby unsticking the coin which is free to drop back into the money item store 27.

Figure 16:
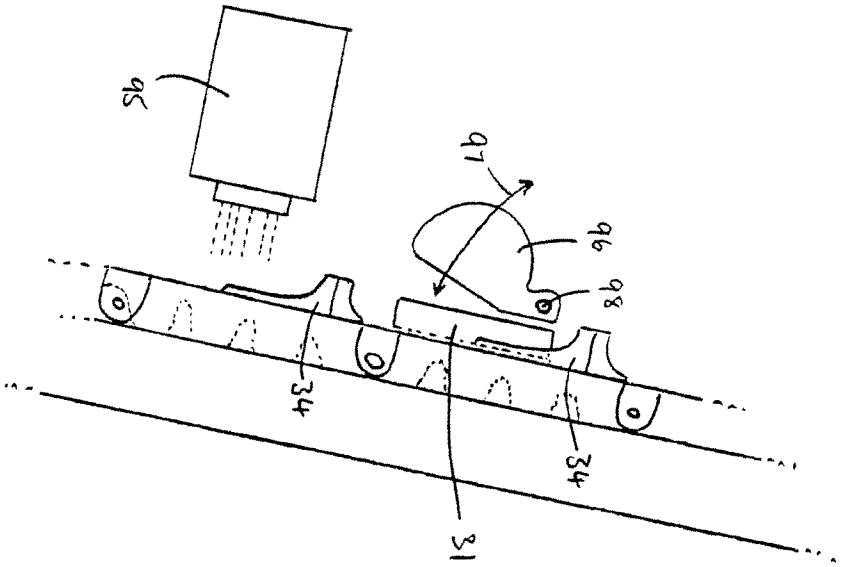
FIG. 16 illustrates a sensing device and an outlet gate for apparatus according to the invention.

The illustrated embodiment can handle tokens as well as single or multiple denomination coins. In other words, it can either pay out coins from the hopper which are all of the same denomination e.g. 10 p or it can handle multiple coins where 1 p, 5 p, 10 p and 50 p pieces are all mixed together in the hopper. With the former single coin handling, a simple hopper output sensor 94 (see FIGS. 3, 4 and 6), e.g. an electrical device such as a photoelectric detector or an inductive proximity device is fitted at the exit 31 and connected to the microprocessor 68, operable so that when the desired number of coins have been dispensed, the motor 29 is switched off. Preferably, the motor 29 is fitted with a brake to prevent inertia induced over-run so that extra coins cannot be paid out after the power supply to the motor 29 has been switched off. If a multi-coin payout is required, then a sophisticated first hopper output sensor 95 is needed operable for instance in conjunction with a solenoid actuated hopper output gate 96. Such an arrangement is illustrated in FIG. 16. The output sensor 95 in this case could be an array of photo-cells at different heights which identify the denomination and count the coins required for the payout until the last coin is due. If the last coin is of too high a denomination, the hopper output gate 96 will be actuated. The hopper output gate 96 is operable to move in the direction of the arrow 97, driven by a motor shaft 98 connected to a hopper output gate solenoid (not shown) which is controlled by the microprocessor 68. The microprocessor 68 provides an appropriate signal to a hopper output gate solenoid driver 99 (see FIG. 6) which drives the hopper output gate solenoid to move the hopper output gate 96 to block the outlet 31. Thus if a coin is not to be ejected, the hopper output gate 96 is driven to a position covering the hopper outlet 31 and the coin will be directed hack into the hopper store 27. This will continue until the correct coin, i.e. a coin of an appropriate denomination to complete the payout, arrives when the gate 96 will revert to its alternative position (as shown in FIG. 16) and the correct coin will be paid out and the conveyor motor 29 switched off.

Figure 17:
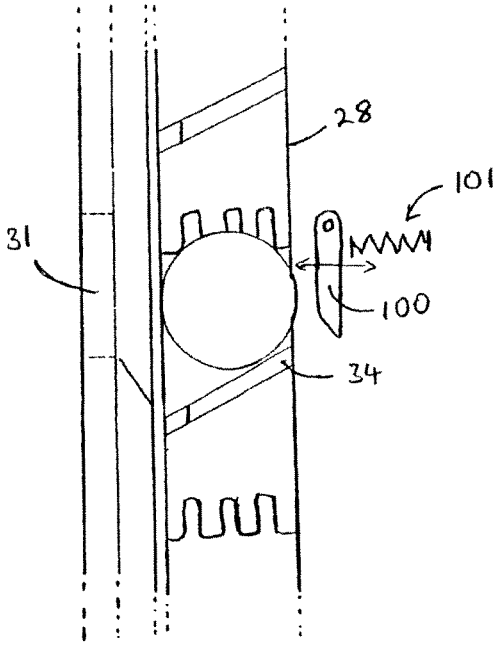
FIG. 17 illustrates an ejecting finger for apparatus according to the invention.

Upon reaching the outlet 31, the coin 12 is ejected through the outlet, in this example due to the force of gravity. However, FIG. 17 illustrates a spring-loaded money item ejector 100 operable to provide an additional force to eject money items through the outlet 31. The ejector 100 is positioned so that it is moved from a money item engaging position against the force of a spring 101 to a discharge position so as to eject the coin 12 through the outlet 31 and thence to the money item engaging position for the next approaching coin to be ejected. The ejector 100 is controlled by the microprocessor 68 such that it is operable to be activated when a money item ejection is required.

In addition to the simple first hopper output sensor 94 or sophisticated first hopper output sensor 95 positioned at the hopper outlet 31, a second hopper output sensor 102 (illustrated schematically in FIG. 6) may also be used, associated with the money item ejector 100. This could be a device such as a mechanically activated of optical counter to act as a further security measure against the risk of the first sensor 94 or 95 being disabled by a fraudster.

Referring again to FIG. 2, the coin 12, once ejected from a receptacle of the conveyor 28, emerges through the hopper outlet 31 and joins the return path 14 leading to a money item collection tray (not shown) for a user to collect.

Emptying the Hopper

Figures 18A, 18B, 18C:
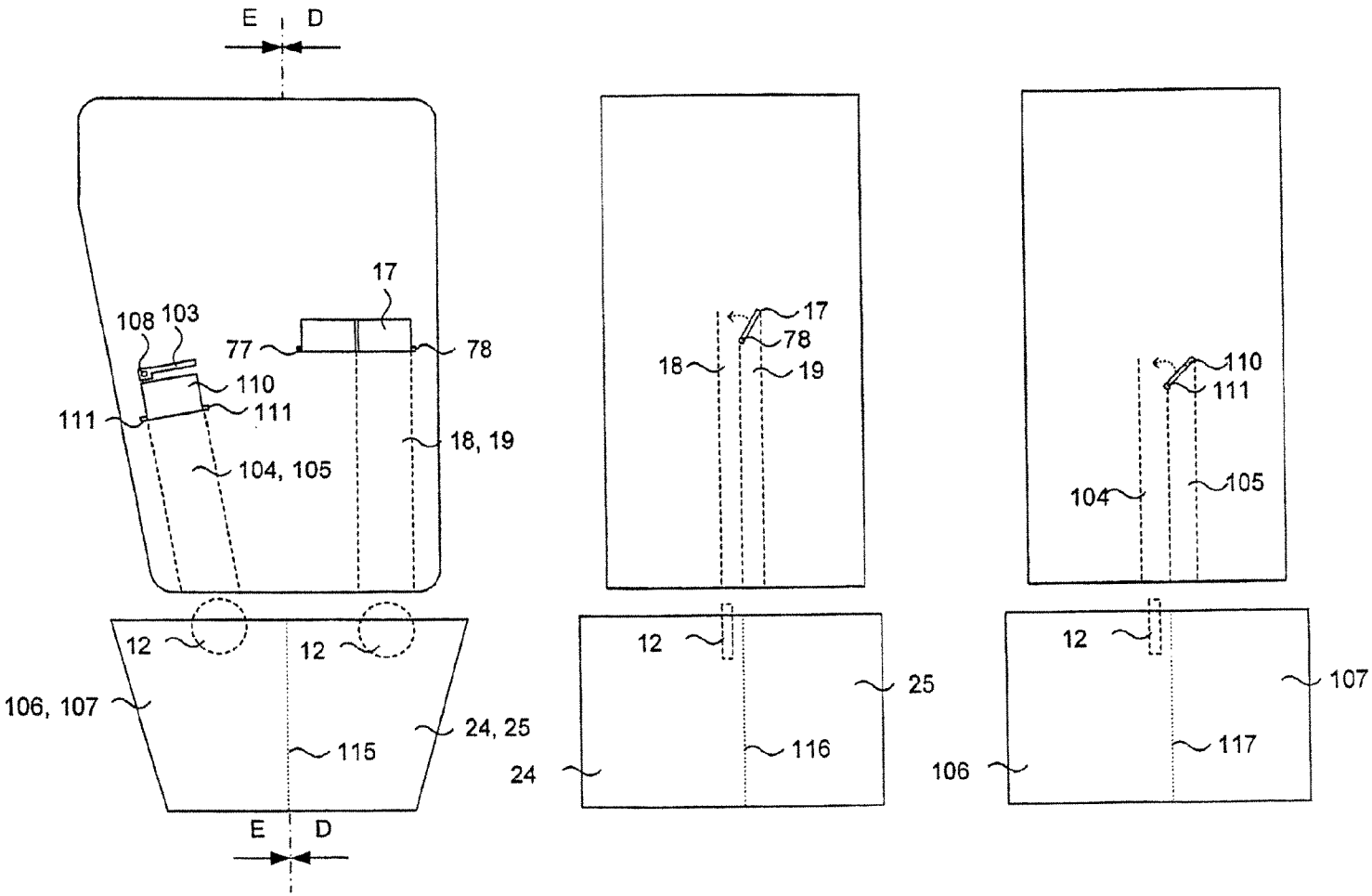
FIG. 18*a* is a first view of a central portion of a unified money item acceptor and hopper apparatus according to the invention, highlighting first and second cashbox chutes within the apparatus and also illustrating a cashbox arrangement. The Figure is also a first view of a first central portion of a unified acceptor and twin hopper apparatus according to the invention.
FIG. 18*b* is a cross-sectional view of the apparatus illustrated in FIG. 18*a*, the view taken from the direction of arrow 'D' in FIG. 18*a;*
FIG. 18*c* is a cross-sectional view of the apparatus illustrated in FIG. 18*a*, the view taken from the direction of arrow 'E' in FIG. 18*a;*

In certain circumstances it is required to empty the hopper of all of its contents, for instance at the end of the day when staff are collecting takings. In this case, appropriate signals are provided by the microprocessor 68 to the conveyor motor driver 87 to drive the conveyor motor 29 to continually eject money items from the hopper outlet 31. Conventionally in this circumstance money items are ejected in the normal way from the hopper outlet 31, via the return path 14, to a money item return tray. However, a feature of the invention is that a purge chute cover 103 (see FIG. 2) may be opened to direct money items from the hopper outlet 31, via first or second purge chutes 104, 105, to third or fourth cashboxes 106, 107. The cover 103 is substantially rectangular and pivoted along one side by a first pin 108 connected to and rotatably driven by a purge chute cover solenoid (not shown) driven by a purge chute cover solenoid driver 109 (see FIG. 6) controlled by appropriate signals provided by the microprocessor 68. A purge chute gate 110 is also provided at the entrance to the first and second purge chutes 104, 105 to direct coins from the outlet 31 to one of the third and fourth cashboxes 106, 107 via one of first and second purge chutes 104, 105 respectively. FIG. 18*c* is a cross-sectional view of the central portion 7 of the unified money item acceptor and hopper 1 taken from the direction of arrow E' in FIG. 18*a*. The purge chute gate 110 is pivoted about a second pin 111 connected via a driving shaft 112 to a purge chute gate solenoid 113 shown in FIG. 2, which controls the position of the gate 110. The purge chute gate 110 is operable to rotate reciprocally as illustrated by the arrow in FIG. 18*c* to direct coins 12 to either the first 104 or second 105 purge chutes. The purge chute gate solenoid 113 is driven by a purge chute gate solenoid driver 114 controlled by the microprocessor 68 illustrated in FIG. 6.

The Cashboxes

Referring to FIGS. 18*a* to 18*c*, these illustrate the central portion 7 of the unified money item acceptor and hopper 1, highlighting the first and second cashbox chutes 18, 19 and the first and second purge chutes 104, 105. Also illustrated are first, second, third and fourth cashboxes 24, 25, 106, 107 for collecting money items from the first and second cashbox chutes 24, 25 and the first and second purge chutes 104, 105 respectively. FIG. 18*b* illustrates a cross-sectional view of the central portion 7 illustrated in FIG. 18*a* taken from the direction of arrow 'D' in FIG. 18*a*. FIG. 18*c* illustrates a cross-sectional view of the central portion 7 illustrated in FIGS. 18*a* and 18*b* taken from the direction of arrow E' in FIG. 18*a*. The cashboxes 24, 25, 106, 107 may be completely independent boxes, may be housed within the same box with any number of first, second or third dividing portions 115, 116, 117, or may be unified to form a single cashbox by the removal of the dividing portions 115, 116 and 117.

The lower region of FIG. 6 outside the dotted box 44 illustrates circuitry within a unified money item acceptor and hopper apparatus 1 other than that within the acceptor 10. In addition to the components previously described this also comprises a memory device 118 associated with the microprocessor 68, a power supply unit 119 and external connection means 120.

The microprocessor 68 may perform the functions that would otherwise be performed by the acceptor microcontroller 46. In this case, the acceptor 10 would not comprise a microcontroller 46 itself and instead one single processor circumscribed by the dashed box 121 would be used in the apparatus 1. Furthermore, the memory 118 associated with the microprocessor 68 may store data that would otherwise be held in the acceptor memory 47. The acceptor 10 would not then comprise an individual memory device 47, but one single memory as circumscribed within the dashed box 122 would be used in the apparatus 1.

Second Embodiment

Figure 19:
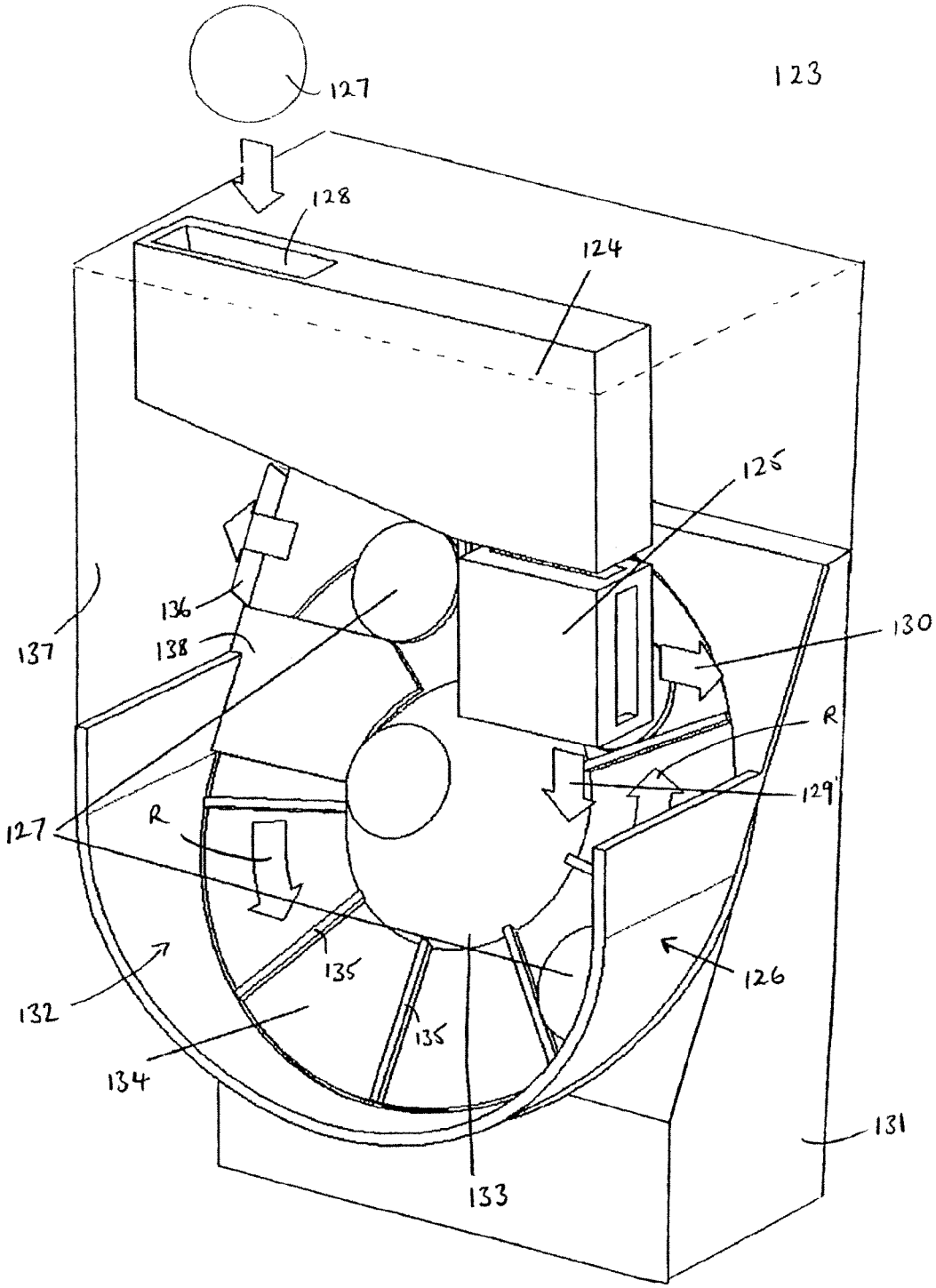
FIG. 19 illustrates a unified acceptor and rotary-disc hopper according to the invention.

FIG. 19 illustrates a unified rotary acceptor and hopper apparatus 123 according to the invention. This comprises an acceptor 124, an accept gate 125 and a hopper arrangement 126. A money item 127 enters the acceptor 124 via an input opening 128. The acceptor 124 of the unified rotary acceptor and hopper apparatus 123 operates in a similar manner to the acceptor 10 of the unified money item acceptor and hopper apparatus 1 previously described. The acceptor 124 illustrated comprises a microcontroller operable to determine the authenticity of an inserted money item and to provide a corresponding signal to cause the accept gate 125 to channel the money item to an accept path 129 or a return path 130. If the money item 127 is found to be unacceptable by the acceptor 124, the money item 127 is directed via the return path 130 to a return tray (not shown) for a user to collect. Alternatively, if found acceptable, the money item 127 is directed to the hopper arrangement 126.

The hopper arrangement 126 comprises a body member 131, a hopper store 132 and a disc-like rotary member 133 mounted on the body member 131. The rotary member 133 is rotated in the direction of arrows 'R' by an electric motor (not shown) mounted within the body member 131, through a reduction gear train (not shown).

In use, the hopper store 132 acts as a money item source and feeds money items into receptacles 134 formed by lips 135 on the surface of the rotary member 133. A coin outlet 136 is provided in the side wall 137 adjacent to a money item ejector device 138. A money item 127 fed into the hopper store 132 from the accept gate 125 is thus fed into a receptacle 134 and, as the rotary member 133 is rotated by the electric motor, it is transported in an annular path until it reaches a position in which it abuts the ejector device 138. The ejector device 138 forces the money item 127 through the outlet 136 and the money item 127 is thus directed to a return tray for a user to collect.

Counting means (not shown) may be incorporated within the device 123 to count money items as they are ejected.

A sorter arrangement similar to that depicted in FIGS. 9, 10 and 11 incorporated in the unified money item acceptor and hopper apparatus 1, may be incorporated in the apparatus 123. This would be operable to selectably direct money items to one or more cashboxes via cashbox chutes similar to those described, according, for instance, to the money item denomination or the fill level of the hopper store 132. The apparatus 123 can further comprise the money item purge gate and associated mechanisms and circuitry as described for the unified money item acceptor and hopper apparatus 1.

Unified Acceptor and Twin Hopper Embodiment

Figure 20:
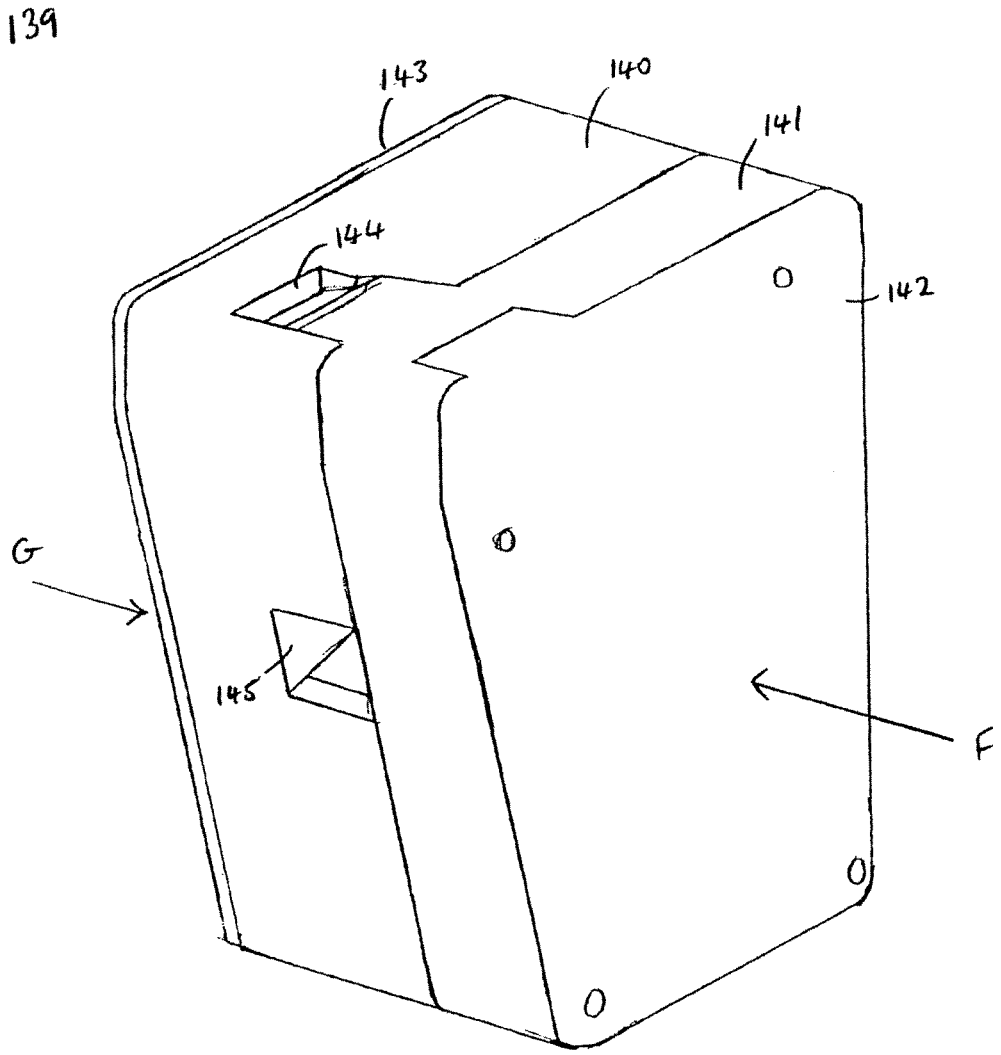
FIG. 20 is a first external view of a twin-hopper apparatus according to the invention.
Figure 21:
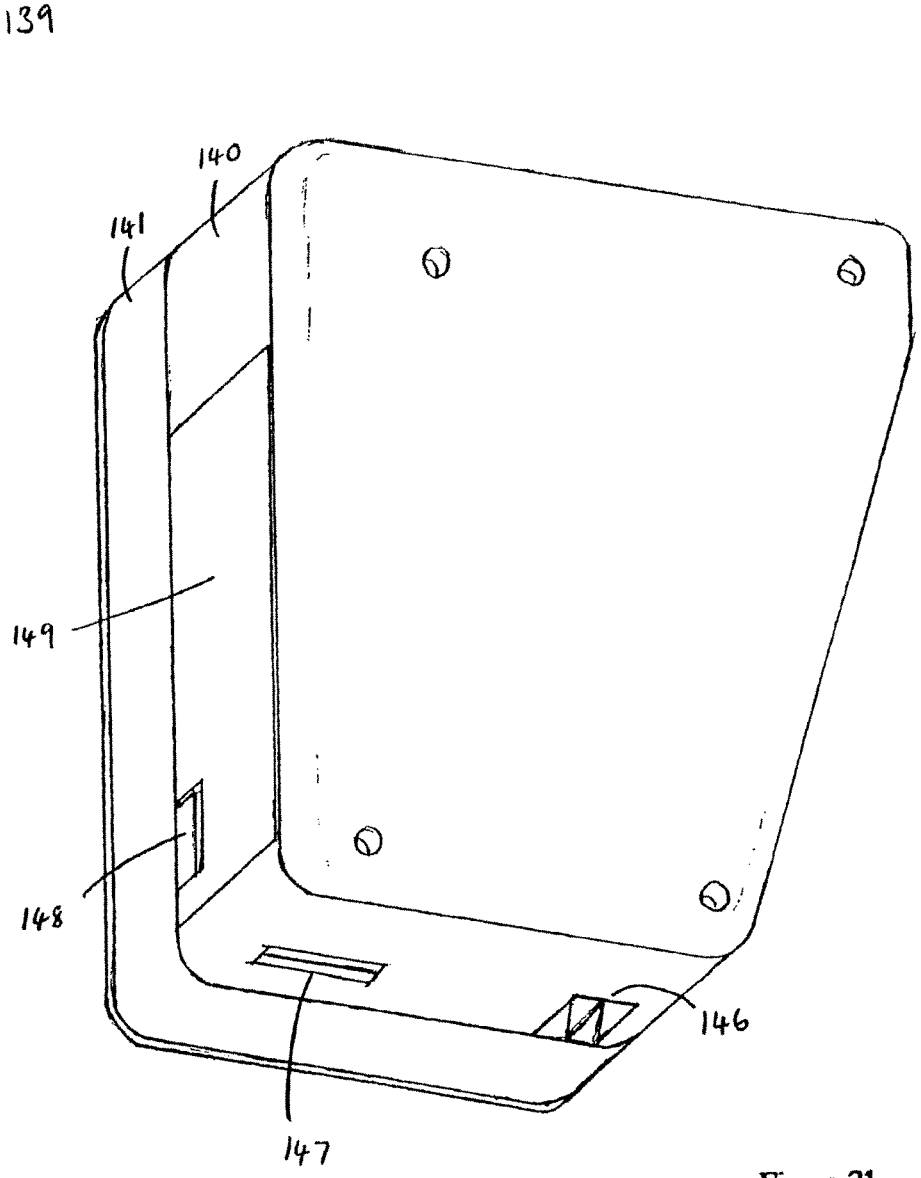
FIG. 21 is a second external view of a twin-hopper apparatus according to the invention.

FIG. 20 is a first external view of a unified acceptor and twin hopper apparatus 139 according to the invention, the apparatus comprising an acceptor unit and first and second hoppers. The unified acceptor and twin hopper apparatus 139 comprises a first central portion 140 and a second central portion 141. In a similar manner to the unified money item acceptor and hopper apparatus 1, first and second covers 142, 143 are also provided. The first central portion 140 of the unified acceptor and twin-hopper apparatus 139 also comprises a money item entry opening 144 and a money item return opening 145. Further openings 146, 147 for money items to exit to one or more cashboxes are also provided in the first central portion as illustrated in FIG. 21. Furthermore, an opening 148 for external connections is provided as well as a printed circuit board cover 149.

The unified acceptor and twin hopper apparatus 139 is the same as the unified money item acceptor and hopper apparatus 1 shown in FIGS. 1 to 4, but with the addition of the second central portion 141, which contains the second hopper arrangement. Referring to FIG. 2, this therefore illustrates a side view of the first central portion 140 of the unified acceptor and twin hopper apparatus 139, the view taken from the direction of the arrow labelled 'F' in FIG. 20.

The second hopper chute 67 leading to the second hopper, unused in the apparatus 1, is used in the unified acceptor and twin hopper apparatus 139 to channel money items to the second hopper located in the second central portion 141 as described in more detail below.

The operation of the unified acceptor and twin hopper apparatus 139, following the insertion into the apparatus 139 of a coin 12, will now be described in. detail with reference to the Figures.

Referring to FIG. 2, a coin 12 entering the unified acceptor and twin hopper apparatus 139 will enter the acceptor 10 and be analysed in a similar manner to that previously described with reference to the single hopper apparatus 1. If the coin 12 becomes jammed in the acceptor 10 it is released automatically through initiation of an acceptance clearance procedure as previously described and is returned to the user via the money item return path 14. Alternatively, if the coin 12 does not jam in the acceptor 10, it leaves the acceptor 10 via the acceptor outlet 43 and is directed by an accept gate 11 to an accept path 13 or return path 14, in accordance with whether or not the coin was found to be genuine by the acceptor microcontroller 46. In accordance with one embodiment of the invention the accept gate 11 of the unified acceptor and twin hopper apparatus 139 operates in the same manner as the accept gate 11 of the unified money item acceptor and hopper apparatus 1 illustrated in FIGS. 7 and 8. The coin 12 is therefore directed to the exit opening 145 via the return path 14 or to the sorter 15 via the accept path 13.

An illustration of the sorter arrangement 15 of the unified acceptor and twin hopper 139 is depicted in FIG. 22 and is the same as the sorter arrangement 15 described for the unified money item acceptor and hopper apparatus 1 with reference to FIGS. 9 to 11. Reference numerals depicted in FIG. 22 follow the same numbering as used in FIGS. 9 to 11.

FIG. 22 illustrates the sorter arrangement wherein the first sorter gate solenoid 57 is activated such that the first sorter arm 59 is extended in order to cause the hopper channel 62 of the first sorter gate 16 to be aligned with the accept path 13 from the accept gate 11. The hopper channel 62 directs money items to one of the first and second hopper chutes 66, 67 according to the position of the second sorter gate 17. In this example the first hopper is used to receive, store and return a first denomination of coins and the second hopper is used to receive, store and return a second denomination of coins. In the example illustrated in FIG. 22, the second sorter gate solenoid 58 is activated such that the second sorter arm 60 is retracted in order to cause the second channelling face 64 of the second sorter gate 17 to be aligned with the hopper channel 62 of the first sorter gate 16 and therefore with the accept path 13. This causes the inserted coin 12 to be directed to the second hopper chute 67 and into the second hopper.

First and second cashbox chutes 18, 19 may be used in the unified acceptor and twin hopper apparatus 139 so that, when either or both of the hoppers are full, entered coins may be directed to one of first and second cashboxes 24, 25 (see FIG. 18*b*) according to their denomination. Alternatively, both of the first and second cashbox chutes 18, 19 may be used for the same denomination of coins or may lead to the same cashbox for receiving a single or multiple denominations of coin, or one or other of the first and second cashbox chutes 18, 19 may be omitted entirely.

The sorter arrangement is operable to direct an inserted coin to the first or to the second hopper arrangements as well as to one or more cashboxes. The first hopper within the twin hopper apparatus 139 is located in the first central portion 140 and according to one aspect of the invention is identical to the hopper of the unified acceptor and hopper 1, which is illustrated in FIGS. 3 and 4. FIG. 3 accordingly illustrates a cross-sectional view of the first central portion 140 of a twin hopper apparatus according to the invention, the view taken from the direction of arrow 'G' in FIG. 20. FIG. 3 is a side elevation of the mechanism of FIG. 4 taken along the line I-I thereof. The first hopper works in a similar manner to that previously described with reference to the unified acceptor and hopper apparatus 1. A sprung ejector 100 such as that illustrated in FIG. 17 may be used to increase the payout speed of the first hopper. Also, the sophisticated hopper output sensor 95 and hopper outlet gate 96 as illustrated in FIG. 16 may be incorporated in the first hopper, for instance where the hopper is to be used for multi-denominations of coins.

Figure 23:
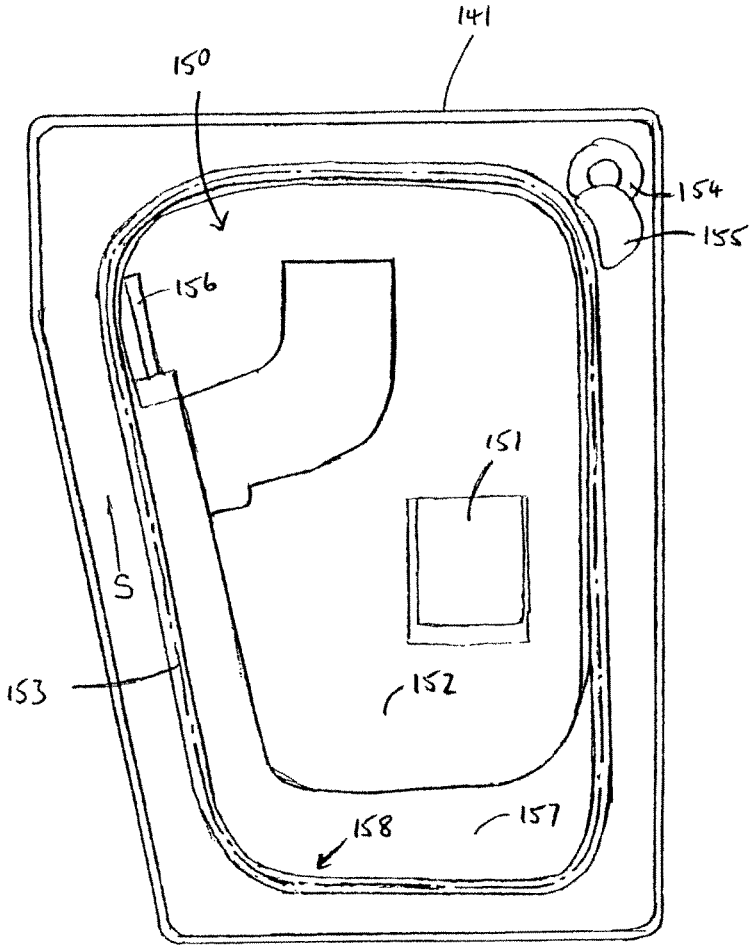
FIG. 23 is an internal view of a second portion of a twin hopper apparatus according to the invention, the view taken from the direction of the arrow 'F' of FIG. 20.

The second hopper of the twin hopper apparatus is located in the second central portion 141. A cross sectional view of this portion 141 of the apparatus 139 is illustrated in FIG. 23. This, in a similar manner to the first hopper, comprises a hopper arrangement 150 including a hopper inlet 151, a hopper store 152, a conveyor 153, a conveyor motor 154 having conveyor gearing means 155 and a money item outlet 156. Coins entering the second hopper do so via the money item inlet 151, which is the end of the second hopper chute 67 as depicted in FIG. 22. Inserted coins then drop into the second hopper store 152. The store 152 has a base 157 that is downwardly inclined such that coins tend to move due to gravity towards the inner side 158 of the conveyor 153. The conveyor 153 is selectably driven in the direction 'S' by the conveyor motor 154 to eject money items through the outlet 156. A sprung ejector 100 such as that illustrated in FIG. 17 may be used to enable the payout speed of the second hopper to be increased. Also, the sophisticated hopper output sensor 95 and hopper outlet gate 96 as illustrated in FIG. 16 may be incorporated in the second hopper, for instance where the second hopper arrangement 150 is to be used for multi-denominations of coins.

From the hopper outlet 156 the coin 12 is ejected via the return path 14 to a tray for a user to collect. The unified acceptor and twin hopper apparatus 139 may further comprise the money item purge gate and associated mechanisms and circuitry as described for the unified money item acceptor and hopper apparatus 1.

FIGS. 18*a* to 18*c*, due to the similarities between the unified acceptor and hopper apparatus 1 and unified acceptor and twin hopper apparatus, illustrate equally the first central portion 140 of the unified acceptor and twin hopper apparatus 139. FIG. 18*c* illustrates a cross-sectional view of the central portion 140 illustrated in FIGS. 18*a* and 18*b* taken from the direction of arrow 'E' in FIG. 18*a*. FIG. 18*c* illustrates the first and second purge chutes 104, 105 leading to the third and fourth cashboxes 106, 107 respectively. The second purge chute 105 was unused in the unified acceptor and hopper apparatus 1, however, in the unified acceptor and twin hopper apparatus 139 the second purge chute 105 is used to direct money items from the second hopper to the fourth cashbox 107. In this manner the first and second hoppers, if used for separate money item denominations or currencies, may have their contents emptied at the end of the day via the first and second purge chutes 104, 105 respectively. Alternatively, a single purge chute may be used to direct money items purged from both the first and second hopper arrangements to a single cashbox.

Twin Hopper Arrangement

In an alternative embodiment the acceptor 10 and accept gate 11 may be omitted from the unified acceptor and twin hopper apparatus 139, which is otherwise as described, making the apparatus simply a twin hopper apparatus. Referring to FIG. 2 and using the reference numerals depicted there, the acceptor 10 and accept gate 11 may be replaced by a money item chute (not shown) extending from the money item input opening 2 to the money item sorter 15 and the electrical circuitry of the device would be adjusted accordingly. This may involve the addition of money item denomination sensing means located, for instance, in the money item chute, to determine the denomination of inputted money items and provide this information to the processor 68. The vending or other machine in which the twin hopper apparatus is installed may also have installed within it an individual acceptor to accept money items inserted into the machine and to feed money items into the twin hopper apparatus entry opening 144. The twin hopper apparatus may in this case receive signals from the individual acceptor indicating the denomination of an inputted money item.

Loop Conveyor

Figure 24:
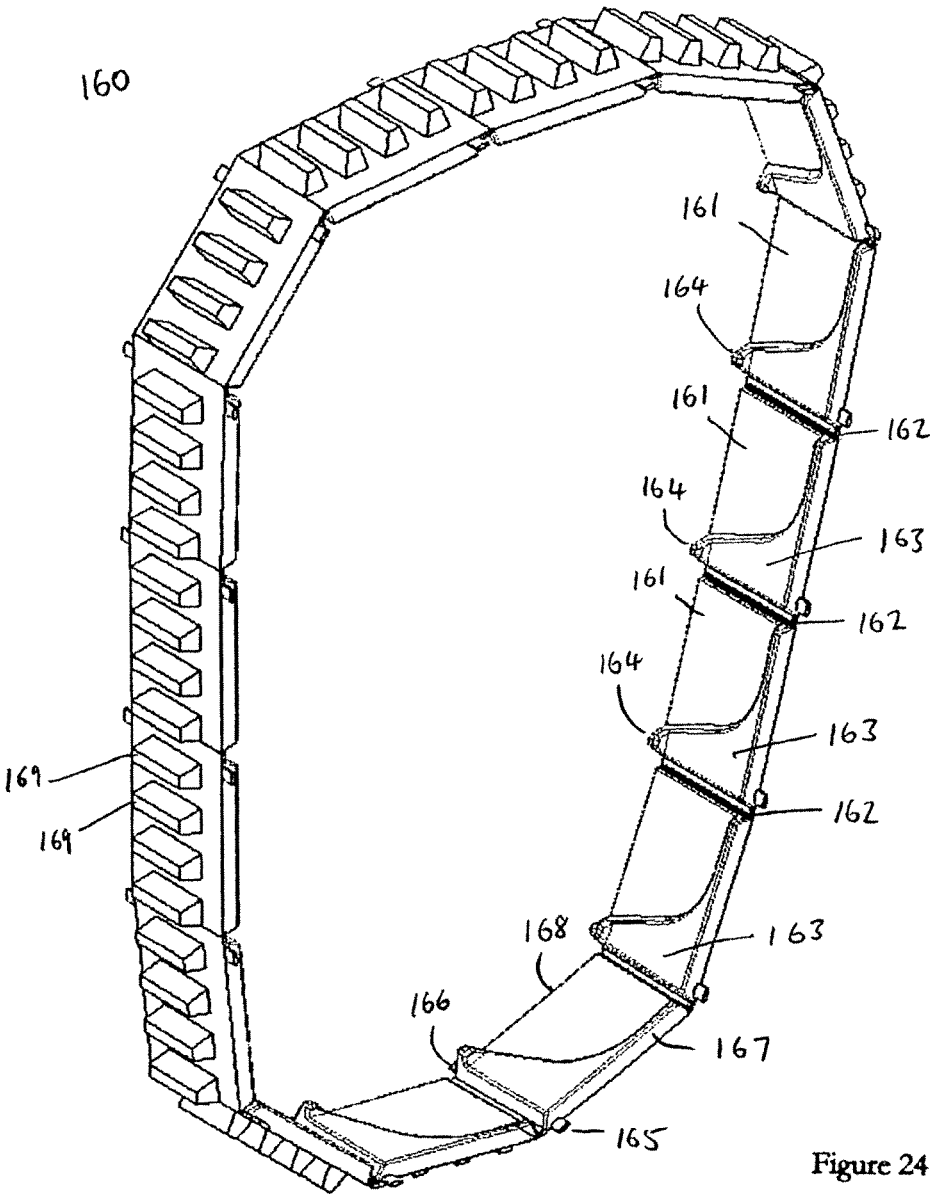
FIG. 24 illustrates a conveyor according to the invention.

FIG. 24 illustrates an embodiment in accordance with the invention of a loop conveyor 160 for a hopper according to the invention. The loop conveyor 160 illustrated is formed in a single moulding from plastic and comprises a plurality of rigid rectangular portions 161 interconnected by a plurality of flexible regions 162 formed by regions of plastic that are thinner than that of the rigid portions 161. Each rigid portion 161 comprises on its inner surface a raised portion forming a lip 163 that extends across the width of each rigid portion 161. At one side of each lip is an upstanding projection 164 that acts as a starrer as previously described when the loop conveyor 160 is in use. Each rigid portion 161 further comprises first and second lugs 165, 166 extending from the first and second longer edges 167, 168 of the rigid portion 161 respectively. These lugs 165, 166, when in use, slide in a track (not shown) within a hopper. The track guides the loop conveyor 160 in an annular path. The rectangular rigid portions 161 also comprise a plurality of teeth 169 on their outer surfaces, which in use mesh with a drive wheel driven by a conveyor motor.

The entire loop conveyor 161 may be formed in a single moulding or alternatively a single moulding could be used to form the basic frame of the loop conveyor 160 with features such as the lips 163, runners 165, 166 and teeth 169 being subsequently welded onto the basic frame of the loop conveyor 160 using a conventional technique.

Hopper Filling Device

Figure 25:
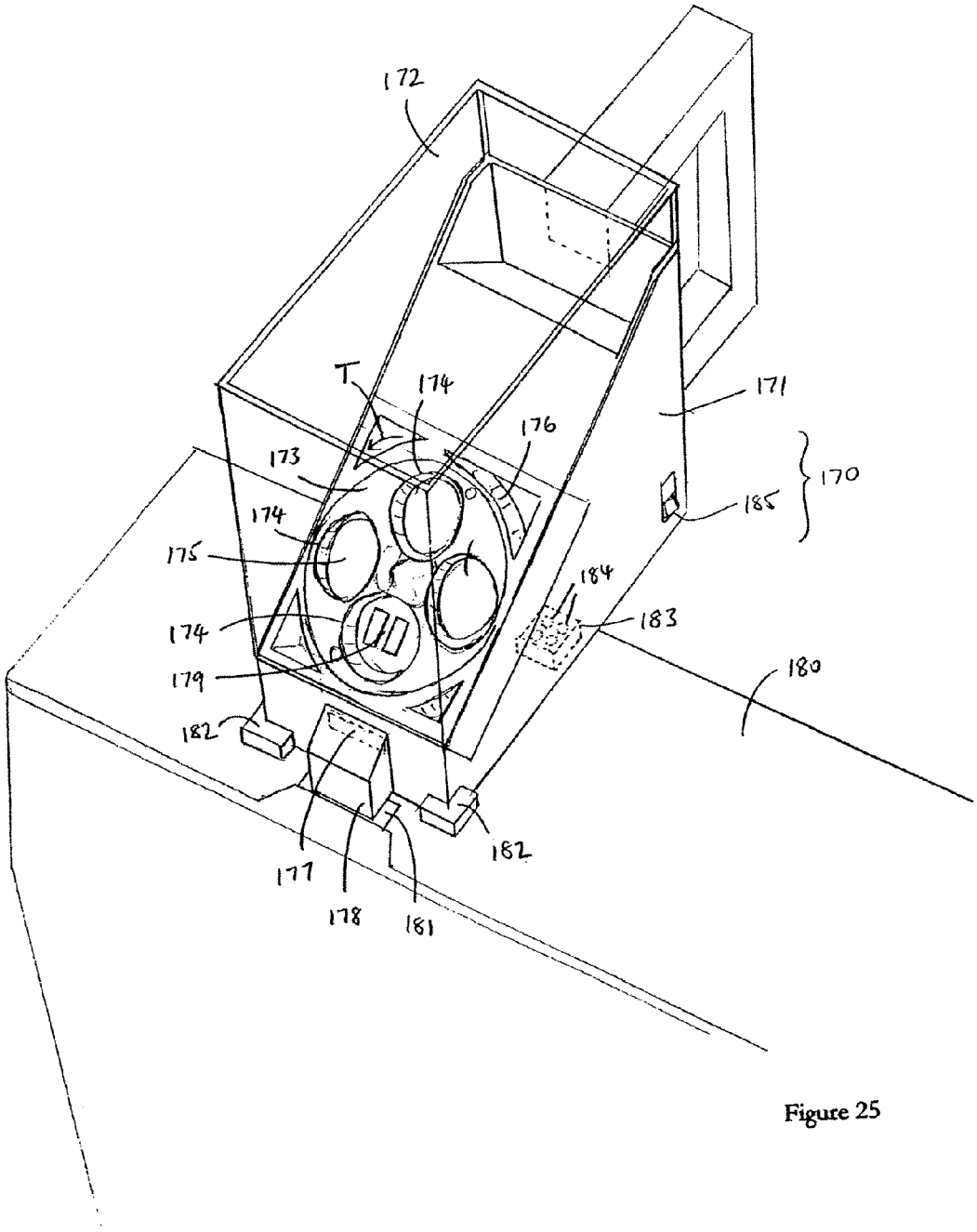
FIG. 25 illustrates a hopper-filling device according to the invention.

FIG. 25 illustrates a hopper filling device 170 according to the invention. This comprises a body member 171, a hopper store 172 and a disc-like rotary member 173 mounted on the body member 171. The rotary member 173 is rotated in the direction of arrow 'T' by an electric motor (not shown) mounted within the body member 171, through a reduction gear train (not shown).

The filling device 170 generally operates in a similar fashion to a money item dispensing apparatus manufactured by Money Controls Limited referred to as the Compact Hopper. Reference is also directed to EP-A-0266021 in relation to the operation of such devices.

In use, coins are fed into the hopper 172 so that the hopper acts as a coin source and feeds coins into circular apertures 174 in the rotary member 173. The coins slide on an inclined side wall 175 of the body member 171 which has an annular upper surface bounded by a circular side wall 176 around the circular edge of the rotary member 173. A coin outlet 177 is provided in the side wall 176, leading via a short coin chute to a coin exit opening 178. A coin ejector device 179 in the form of a pivoted fork member has first and second coin engaging members protruding through openings in the inclined wall 175 of the body member 171.

The filling device 170 is located in a position associated with a coin dispensing device 180 to be filled such that a continuous money item path is created between the coin exit opening 178 and a coin input 181 of the dispensing device 180. Locating members 182 can be provided to aid the positioning of the filling device 170. These can be located on a surface of the dispensing apparatus as illustrated or alternatively may be located on the filling device 170.

A money item fed into the hopper 172 is thus fed into a circular aperture 175 and, as the rotary member 173 is rotated by the electric motor, it is transported in an annular path until it reaches a position in which it abuts the ejector device 179. The ejector device 179 ejects the money item through the outlet 177 and the money item is thus directed to the coin exit opening 178. From this opening 178, by virtue of the continuous money item path between the coin exit opening 178 and a coin input 181 of the dispensing apparatus 180, the coin is directed into the dispensing apparatus 180.

Counting means (not shown) may be incorporated within the filling device 170 to count money items as they are ejected. The number of money items ejected may be displayed on an LCD or other form of display (not shown) on the filling device 170. The filling device may also comprise connecting means 183 that locate with connecting means associated with the dispensing apparatus 180. In this way, one or more electrical connections 184 are made between the filling device 170 and the money item dispensing apparatus 180. The filling device 170 may accordingly receive power and command signals from the money item dispensing apparatus. The filling device 170 may provide one or more signals to the dispensing apparatus 180 indicating, for instance, the number of coins that have been ejected from the filling device 170. In the example illustrated, the filling device 170 is provided with a switch 185 for initiating and terminating operation of the device 170.

As used herein the term "money item" includes coins, tokens and other similar items having an attributable monetary value.

The acceptors described herein do not necessarily have sensors formed by inductor coils. Other sensing means such as optical sensors may alternatively be used in the acceptor. In this circumstance the acceptor circuitry would be adjusted accordingly, this, for instance, involving alterations to the coil drive and interface circuitry 45 and the operation of the acceptor microcontroller 46.

The invention claimed is:

1. Money item dispensing apparatus for a money item-operated machine, the apparatus comprising:

a money item source;

a money item receptacle;

a feeding arrangement to feed a money item from the money item source into the receptacle;

an outlet;

a motor to move the money item in the receptacle to a position associated with the outlet;

an ejector to eject the money item from the receptacle through the outlet; and a gate arrangement configured to direct the money item after passing the outlet along either a first path to a money item return opening or a second path to an opening for a cashbox, the money item dispensing apparatus configured to dispense money items of a plurality of different denominations, and including a sensor for sensing denominational characteristics of the money items and a loop conveyor for the dispensation of money items successively, for transporting the money items towards the first and second paths, wherein the loop conveyor is operable to return money items not passed to the first or second paths, to the money item source.

2. Money item dispensing apparatus according to claim 1, wherein the money item dispensing apparatus includes a plurality of the receptacles for the dispensation of money items successively and the money item source is configured to receive and supply to each receptacle, money items that have been accepted by a money item acceptor.

3. Money item dispensing apparatus according to claim 1, including a housing that includes an inlet for money items on the top of the housing, the money item return opening being on a side of the housing and the opening for the cash box being on the underneath of the housing.

4. Money item dispensing apparatus according to claim 3, including control circuitry including a microprocessor within the housing.

5. Money item dispensing apparatus according to claim 1, wherein the money item dispensing apparatus includes a plurality of the receptacles for the dispensation of money items successively and wherein the source of money items comprises a hopper arrangement, and the feeding arrangement comprises an inclined surface to direct money items in the hopper into each said receptacle.

6. Money item dispensing apparatus according to claim 1, including a counter to count money items as they are dispensed.

7. A method of discharging money items from a money item dispensing apparatus to a cashbox, the money item dispensing apparatus configured to dispense money items of a plurality of different denominations, the method comprising:

operating a motor to drive a loop conveyor that includes a plurality of receptacles for the dispensation of money items successively;

feeding money items from a money item source into the receptacles;

moving the money items in the receptacles towards a first path leading to a money item return opening and a second path leading to an opening for the cashbox;

sensing denominational characteristics of the money items;

selectively directing the money items from the receptacles via either the first path to a money item return opening or via the second path to an opening for the cashbox; and returning money items not passed to the first or second paths, to the money item source.

8. A method according to claim 7, including purging the apparatus of all money items into the cashbox.

9. Money item dispensing apparatus for a money item-operated machine, the apparatus comprising:

a housing having an inlet for money items, an outlet for dispensing change to a user and an outlet for discharging money items to a cashbox;

a moveable loop conveyor comprising an arrangement of money item receptacles;

a hopper for money items that have been accepted by a money item acceptor, the hopper being configured to feed the money items individually into successive ones of the receptacles;

a motor for driving the moveable loop conveyor to transport money items in the receptacles towards a first path leading to a money item return opening and a second path leading to an opening for the cashbox; and a gate arrangement for directing the money items selectively from the receptacles via the first path to the money item return opening for a user to collect as change, and for directing the money items selectively from the receptacles through a second path to the opening for a cashbox to purge money items from the apparatus wherein, the moveable loop conveyor is operable to return money items not passed to the first or second paths, to the money item source and wherein the money item dispensing apparatus is configured to dispense money items of a plurality of different denominations, and includes a sensor for sensing denominational characteristics of the money items.

* * * * *